US008668299B2

(12) United States Patent
Tanase et al.

(10) Patent No.: US 8,668,299 B2
(45) **Date of Patent: *Mar. 11, 2014**

(54) FLUID-EJECTING DEVICE AND FLUID-EJECTING METHOD FOR EJECTING A FLUID FROM NOZZLE COLUMNS

(75) Inventors: Kazuyoshi Tanase, Matsumoto (JP); Toru Takahashi, Azumino (JP); Takamitsu Kondo, Shiojiri (JP); Hiroshi Wada, Azumina (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

This patent is subject to a terminal disclaimer.

(21) Appl. No.: 13/399,201

(22) Filed: Feb. 17, 2012

(65) Prior Publication Data

US 2012/0212534 A1 Aug. 23, 2012

(30) Foreign Application Priority Data

Feb. 18, 2011 (JP) ..... 2011-033524

(51) Int. Cl.
*B41J 2/205* (2006.01)

(52) U.S. Cl.
USPC ..... 347/15

(58) Field of Classification Search
USPC ..... 347/15, 5, 41, 40, 14, 9; 358/3.23
See application file for complete search history.

(56) References Cited

U.S. PATENT DOCUMENTS

| | | | | |
|---|---|---|---|---|
| 2003/0142154 | A1* | 7/2003 | Fujimori | 347/9 |
| 2006/0214957 | A1* | 9/2006 | Wada | 347/5 |
| 2007/0165068 | A1* | 7/2007 | Tsuboi | 347/41 |
| 2007/0242098 | A1* | 10/2007 | Sudo et al. | 347/40 |
| 2011/0063354 | A1 | 3/2011 | Enge | |
| 2011/0080615 | A1* | 4/2011 | Ono et al. | 358/3.23 |
| 2011/0316911 | A1 | 12/2011 | Ishikawa et al. | |
| 2012/0206525 | A1* | 8/2012 | Tanase et al. | 347/14 |

FOREIGN PATENT DOCUMENTS

JP 06-255175 A 9/1994

* cited by examiner

*Primary Examiner* — Alessandro Amari
*Assistant Examiner* — Carlos A Martinez
(74) *Attorney, Agent, or Firm* — Global IP Counselors, LLP

(57) ABSTRACT

To minimize deterioration in the dispersion of dots in an overlapping region between heads, a fluid-ejecting device includes: (A) a first nozzle column having first nozzles for ejecting a fluid; (B) a second nozzle column having second nozzles for ejecting a fluid and arranged to form an overlapping region in which an end portion toward one end in the predetermined direction overlaps an end portion at another end of the first nozzle column; and (C) a controller for ejecting a fluid from the first nozzle column and the second nozzle column in accordance with dot data indicating a dot size converted from inputted image data and ejecting the fluid from the second nozzles in the overlapping region in accordance with dot data obtained from a halftone process performed after multiplying the usage rate of the second nozzle column by incidence rate data for each of the dot sizes.

8 Claims, 23 Drawing Sheets

Fig. 12A
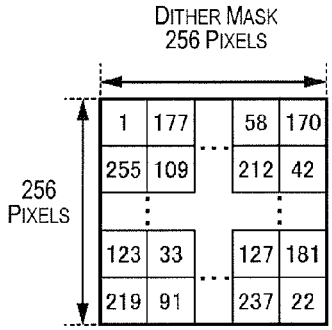
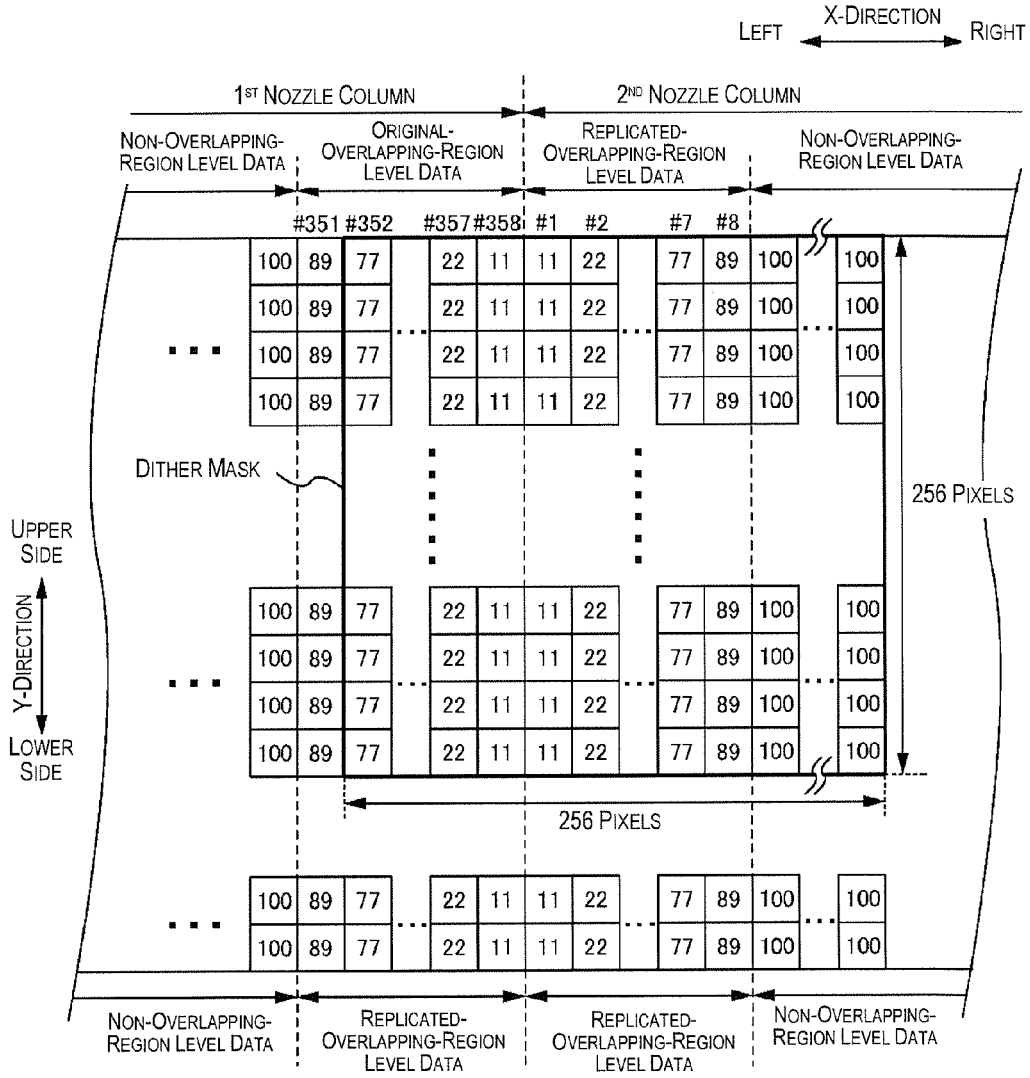
Fig. 12B

DITHER MASK IN WHICH STORING THRESHOLDS 0 THROUGH 24 HAVE BEEN ESTABLISHED

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | 17 | | | | 7 | | | | | 14 |
| 2 | | | 1 | | | | | | 24 | |
| 3 | | | | | | 20 | | 5 | | |
| 4 | | 13 | | | 10 | | | | | |
| 5 | | | 6 | | | | | | | 11 |
| 6 | | 23 | | | | 2 | | 15 | | |
| 7 | 19 | | 9 | | | | 0 | | | |
| 8 | | | | | 22 | | | 4 | | |
| 9 | | 3 | | 16 | | | 21 | | | |
| 10 | 12 | | | | | 8 | | | 18 | |

MG24

STATE OF FORMATION OF DOTS CORRESPONDING TO ELEMENTS STORING ESTABLISHED THRESHOLDS

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | ● | | | | ● | | | | | ● |
| 2 | | | ● | | | | | | ● | |
| 3 | | | | | | ● | | ● | | |
| 4 | | ● | | | ● | | | | | |
| 5 | | | ● | | | | | | | ● |
| 6 | | ● | | | | ● | | ● | | |
| 7 | ● | | ● | | | | ● | | | |
| 8 | | | | | ● | | | ● | | |
| 9 | | ● | | ● | | | ● | | | |
| 10 | ● | | | | | ● | | | ● | |

Dda

● CORRESPONDS TO ELEMENT STORING ESTABLISHED THRESHOLD

Fig. 15

COLUMN NUMBER

| ROW NUMBER | 1 | 2 | 3 | 4 | 5 | 6 | 7 | 8 | 9 | 10 | NUMBER OF ESTABLISHED THRESHOLDS IN ROW DIRECTION |
|---|---|---|---|---|---|---|---|---|---|---|---|
| 1 | 17 | *1 | *2 | *3 | 7 | | | | | 14 | 3 |
| 2 | | | 1 | | | | | | 24 | | 2 |
| 3 | | | | | | 20 | | 5 | | | 2 |
| 4 | | 13 | | | 10 | | | | | | 2 |
| 5 | | | 6 | | | | | | | 11 | 2 |
| 6 | | 23 | | | | 2 | | 15 | | | 3 |
| 7 | 19 | | 9 | | | | 0 | | | | 3 |
| 8 | | | | | 22 | | | 4 | | | 2 |
| 9 | | 3 | | 16 | | | 21 | | | | 3 |
| 10 | 12 | | | | | 8 | | | 18 | | 3 |
| NUMBER OF ESTABLISHED THRESHOLDS IN COLUMN DIRECTION | 3 | 3 | 3 | 1 | 3 | 3 | 2 | 3 | 2 | 2 | |

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | 1 | 0 | 0 | 0 | 0 | 0 | 1 | 0 | 0 | 1 |
| 2 | 0 | 0 | 1 | 0 | 0 | 0 | 0 | 0 | 1 | 0 |
| 3 | 0 | 0 | 0 | 0 | 0 | 1 | 0 | 1 | 0 | 0 |
| 4 | 0 | 1 | 0 | 0 | 1 | 0 | 0 | 0 | 0 | 0 |
| 5 | 0 | 0 | 1 | 0 | 0 | 0 | 0 | 0 | 0 | 1 |
| 6 | 0 | 1 | 0 | 0 | 0 | 1 | 0 | 1 | 0 | 0 |
| 7 | 1 | 0 | 1 | 0 | 0 | 0 | 1 | 0 | 0 | 0 |
| 8 | 0 | 0 | 0 | 0 | 1 | 0 | 0 | 1 | 0 | 0 |
| 9 | 0 | 1 | 0 | 1 | 0 | 0 | 1 | 0 | 0 | 0 |
| 10 | 1 | 0 | 0 | 0 | 0 | 1 | 0 | 0 | 1 | 0 |

Dda1

Fig. 19

FLUID-EJECTING DEVICE AND FLUID-EJECTING METHOD FOR EJECTING A FLUID FROM NOZZLE COLUMNS

CROSS-REFERENCE TO RELATED APPLICATIONS

This application claims priority to Japanese Patent Application No. 2011-033524 filed on Feb. 18, 2011. The entire disclosure of Japanese Patent Application No. 2011-033524 is hereby incorporated herein by reference.

BACKGROUND

1. Technical Field

The present invention relates to a fluid-ejecting device and a fluid ejecting method.

2. Background Technology

There can be cited as a fluid-ejecting device an inkjet printer ("printer") in which ink (fluid) is ejected from nozzles provided in a head to form an image. In this type of printer, a plurality of short heads are aligned in the paper width direction, and ink is ejected from the heads onto a medium conveyed below the plurality of heads to form an image.

A printer has been disclosed in Patent Citation 1 in which the plurality of heads are arranged so that the ends of each head (a portion of the nozzle columns) overlap.

Japanese Patent Application Publication No. 6-255175 (Patent Citation 1) is an example of the related art.

SUMMARY

Problems to be Solved by the Invention

In a printer having heads whose ends overlap, the dots (dot data after halftone process) to be formed where the heads come together ("overlapping region") are distributed to one or the other head aligned in the paper width direction using a mask. However, the halftone process and the dot process are performed independently. Thus, there is no relationship between the dispersion of the dots in the halftone process and the dispersion of the dots in the masking process, and the dispersion of dots in the overlapping region deteriorates. In other words, it is desirable to minimize deterioration in the dispersion of dots in the overlapping region between heads. In view whereof, it is an advantage of the invention to minimize deterioration in the dispersion of dots in the overlapping region between heads.

Means Used to Solve the Above-Mentioned Problems

In order to achieve this purpose, the invention is related to primarily a fluid-ejecting device including:

(A) a first nozzle column having first nozzles for ejecting a fluid, the first nozzle column being aligned in a predetermined direction;

(B) a second nozzle column having second nozzles for ejecting a fluid, the second nozzle column being aligned in the predetermined direction, and arranged to form an overlapping region in which an end portion toward one end in the predetermined direction overlaps an end portion toward another end of the first nozzle column in the predetermined direction; and (C) a controller for ejecting a fluid from the first nozzle column and the second nozzle column in accordance with dot data indicating a dot size converted from inputted image data, the controller ejecting a fluid from the first nozzles in the overlapping region in accordance with dot data obtained from a halftone process performed after multiplying a usage rate of the first nozzle column by incidence rate data for each of the dot sizes, and ejecting the fluid from the second nozzles in the overlapping region in accordance with dot data obtained from a halftone process performed after multiplying the usage rate of the second nozzle column by incidence rate data for each of the dot sizes.

Other features of the invention will become apparent from the specification and the description of the accompanying drawings.

BRIEF DESCRIPTION OF THE DRAWINGS

Referring now to the attached drawings which form a part of this original disclosure:

FIG. 12A is a diagram showing a dither mask;

FIG. 12B is a diagram showing halftone process using dithering;

FIG. 15 is a drawing used to illustrate a matrix MG24 showing a scheme in which the first 25 thresholds (0 through 24) for which a dot is most readily formed are stored in a matrix, and to illustrate a scheme in which a dot is formed on each of 25 pixels corresponding to those elements;

FIG. 17 is a descriptive diagram showing the row-direction established threshold numbers and the column-direction established threshold numbers;

FIG. 18 is a descriptive diagram showing a state (dot pattern Dpa1) in which the dots corresponding to the storage candidate elements and the dots corresponding to the established thresholds have been turned on;

FIG. 19 is a descriptive diagram used to illustrate a matrix in which this state of formation of dots has been quantified, i.e., a dot density matrix Dda1 in which dot density is quantitatively represented;

DETAILED DESCRIPTION OF EXEMPLARY EMBODIMENTS

Figure 1A:
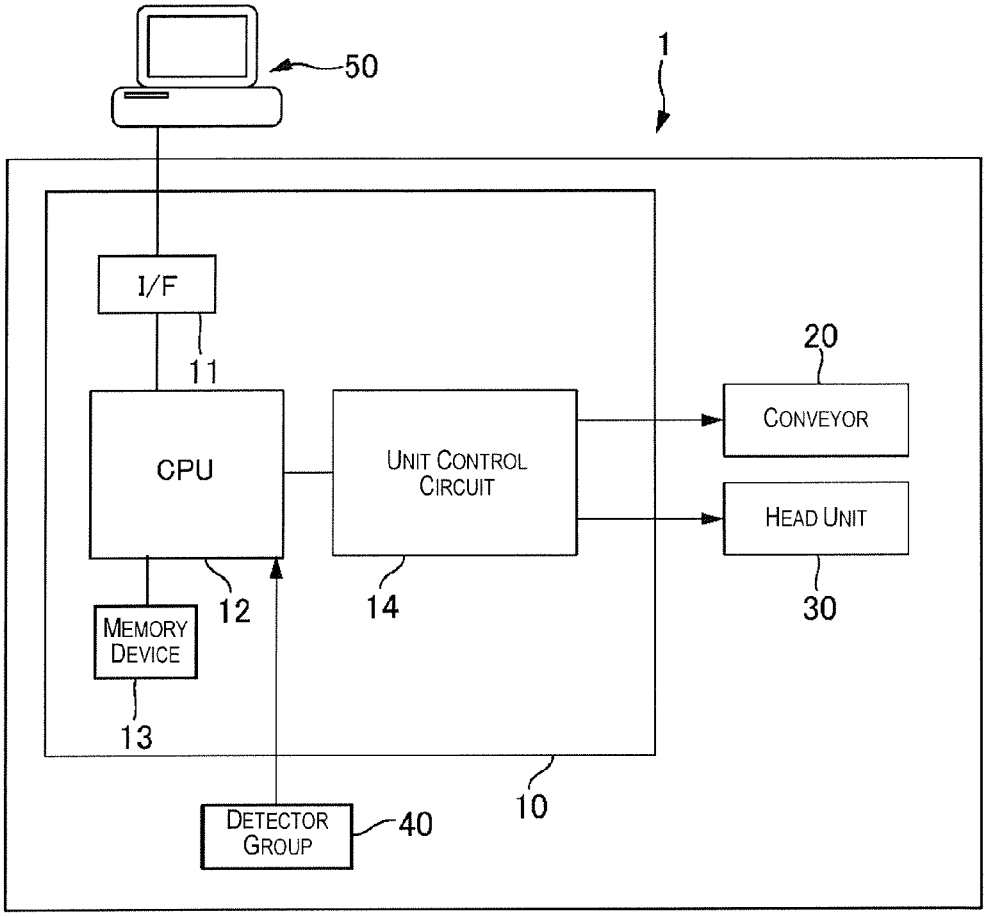
FIG. 1A is a block diagram of the overall configuration of a printer 1.

At least the following elements shall be apparent from the specification and the description of the accompanying drawings. A fluid-ejecting device including: (A) a first nozzle column having first nozzles for ejecting a fluid, the first nozzle column being aligned in a predetermined direction; (B) a second nozzle column having second nozzles for ejecting a fluid, the second nozzle column being aligned in the predetermined direction, and arranged to form an overlapping region in which an end portion toward one end in the predetermined direction overlaps an end portion at another end of the first nozzle column in the predetermined direction; and (C) a controller for ejecting a fluid from the first nozzle column and the second nozzle column in accordance with dot data indicating a dot size converted from inputted image data, the controller ejecting a fluid from the first nozzles in the overlapping region in accordance with dot data obtained from a halftone process performed after multiplying a usage rate of the first nozzle column by incidence rate data for each of the dot sizes, and ejecting the fluid from the second nozzles in the overlapping region in accordance with dot data obtained from a halftone process performed after multiplying the usage rate of the second nozzle column by incidence rate data for each of the dot sizes. It is thereby possible to not perform a masking process after the halftone process. Because the halftone process is performed after the usage rate of the first nozzles and the second nozzles have been multiplied by the incidence rate data for each of the dot sizes, it is possible to minimize deterioration in the dispersion of dots in the overlapping region between heads.

In a fluid-ejecting device of such description, it is desirable that the controller replicate, among the inputted image data, image data corresponding to the overlapping region; insert image data corresponding to the replicated overlapping region in the inputted image data, perform a halftone process on data obtained by multiplying the usage rate of the end portion at the another end of the first nozzle column by incidence rate data for each of the dot sizes generated on the basis of image data corresponding to the overlapping region; and perform a halftone process on data obtained by multiplying the usage rate for the end portion at the one end of the second nozzle column by incidence rate data for each of the dot sizes generated based on image data corresponding to the inserted overlapping region. In this way, dot data can be generated properly in the overlapping region.

It is also desirable that the incidence rate data for each of the dot sizes be determined in accordance with a table indicating the dot size formed in accordance with a gradation value of the inputted image data, and the incidence rate for the dot size. In this way, the dot size to be formed and the incidence rate of the dot size can be obtained in accordance with the table.

It is also desirable that a different table for determining incidence rate data for each of the dot sizes be used in an overlapping region and in a non-overlapping region which is not an overlapping region. In this way, the table can be used to generate with a higher probability dots in an overlapping region that are smaller than those in a non-overlapping region.

It is also desirable that the usage rate of the first nozzles belonging to the overlapping region be greater than the usage rate of the first nozzles positioned towards the another end relative thereto, and the usage rate of the second nozzles belonging to the overlapping region be greater than the usage rate of the second nozzles positioned towards the one end relative thereto. In this way, the borders in an image formed by different nozzle columns can be rendered less noticeable.

It is also desirable that a threshold of a dither mask used in the halftone process be established so that the difference in dot density at which predetermined pixel groups are individually formed in accordance with a value obtained by multiplying the usage rate by the incidence rate data for each of the dot sizes is within a predetermined range. In this way, it is possible to realize halftone process that minimizes partial and local density irregularities in the image to be formed.

At least the following items shall also be apparent from the specification and the description of the accompanying drawings. A fluid-ejecting device including:

(A) a head including a nozzle column in which nozzles for ejecting a fluid are aligned in a predetermined direction;

(B) a moving unit for moving the head in an intersecting direction that intersects the predetermined direction;

(C) a conveyor for conveying in the predetermined direction a medium on which the fluid is ejected; and (D) a controller for performing a first dot forming operation for moving the head in the intersecting direction and ejecting the fluid, and for subsequently performing a second dot forming operation for conveying the medium, moving the head in the intersecting direction, and ejecting the fluid; the controller forming on the medium an overlapping region using one end of the nozzle column in the first dot forming operation and another end of the nozzle column in the second dot forming operation; ejecting the fluid from the nozzle column in accordance with the dot data indicating the dot size converted from the inputted image data; and ejecting the fluid in the overlapping region from the nozzles at the one end in accordance with dot data obtained from a halftone process performed after the usage rate at the one end in the first dot forming operation is multiplied by the incidence rate data for each of the dot sizes; and ejecting the fluid in the overlapping region from the nozzles at the another end in accordance with dot data obtained from a halftone process performed after the usage rate at the another end in the second dot forming operation is multiplied by the incidence rate data for each of the dot sizes.

It is thereby possible to not perform a masking process after the halftone process. Because the halftone process is performed after the usage rate of the one end and the other end of the nozzle column in an overlapping region has been multiplied by the incidence rate data for each of the dot sizes, it is possible to minimize deterioration in the dispersion of dots in the overlapping region between heads.

At least the following element is also apparent from the specification and the description of the accompanying drawings.

A fluid ejecting method for ejecting fluid from a fluid-ejecting device including:

a first nozzle column having first nozzles for ejecting a fluid, the first nozzle column being aligned in a predetermined direction, and a second nozzle column having second nozzles for ejecting a fluid, the second nozzle column being aligned in the predetermined direction, and being arranged to form an overlapping region in which an end portion toward one end in the predetermined direction overlaps with an end portion at another end of the first nozzle column in the predetermined direction; the fluid ejecting method including the steps of:

(A) determining, for the overlapping region, dot data obtained from a halftone process performed after the usage rate of the first nozzle column is multiplied by the incidence rate data for each of the dot sizes; and determining, for the overlapping region, dot data obtained from a halftone process performed after the usage rate of the second nozzle column is multiplied by the incidence rate data for each of the dot sizes, and (B) ejecting the fluid from the nozzles of the first nozzle column in the overlapping region in accordance with the dot data of the first nozzle column, and ejecting the fluid from the nozzles of the second nozzle column in the overlapping region in accordance with the dot data of the second nozzle column.

===System Configuration===

An embodiment will now be described in which the fluid-ejecting device is a printing system in which a line head printer-type inkjet printer (referred to below simply as the printer 1) is connected to a computer 50.

Figure 1B:
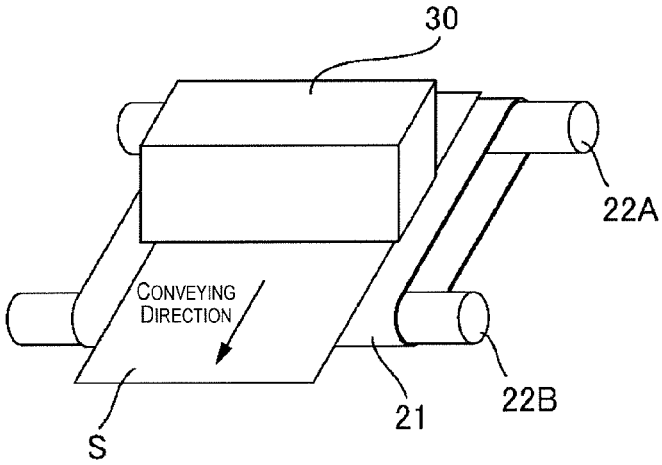
FIG. 1B is a schematic diagram of the printer 1.

FIG. 1A is a block diagram of the overall configuration of the printer 1, and FIG. 1B is a schematic diagram of the printer 1. As shown, the printer 1 conveys a sheet S (medium). When the printer 1 has received printing data from the computer 50, which is an external device, the controller 10 controls individual units (a conveyor 20 and a head unit 30), and prints an image on a sheet S. Also, the status inside the printer 1 is monitored by a detector group 40, and the controller 10 controls each of the units on the basis of the detection results.

The controller 10 is a controller for controlling the printer 1. An interface part 11 enables the exchange of data between the printer 1 and the computer 50, which is an external device. The CPU 12 is an arithmetic processor for controlling the entire printer 1. A memory device 13 is used to secure a region for storing a program of the CPU 12, a task region, and the like. In the CPU 12, each of the units is controlled by a unit control circuit 14 in accordance with a program stored in the memory device 13.

The conveyor 20 has a conveyor belt 21 and conveying rollers 22A, 22B. A sheet S is fed to a location where printing can be performed, and the sheet S is conveyed at a predetermined conveyance speed. A sheet S is fed onto the conveyor belt 21, and the sheet S is conveyed on top of the conveyor belt 21 by causing the conveyor belt 21 to rotate using conveying rollers 22A, 22B. The sheet S on top of the conveyor belt 21 is electrostatically chucked, vacuum-chucked, or otherwise held in place from below.

The head unit 30 is used to eject ink droplets onto the sheet S, and has a plurality of heads 31. A plurality of nozzles, which are the ink ejecting units, are provided on the bottom surface of the head 31. A pressure chamber (not shown), and a drive element (piezo element) for changing the volume of the pressure chamber and ejecting ink, are provided for each nozzle.

In this printer 1, when the controller 10 receives printing data, the controller 10 first feeds a sheet S onto the conveyor belt 21. Afterwards, the sheet S is conveyed at a fixed speed without stopping on top of the conveyor belt 21, and faces the nozzle surface of the head 31. Ink droplets are ejected intermittently from each nozzle on the basis of image data as the sheet S is conveyed underneath the head unit 30. As a result, rows of dots (referred to as raster lines below) are formed in the conveying direction on top of the sheet S, and an image is printed. The image data is composed of a plurality of pixels arranged two-dimensionally, and each pixel (data) indicates whether or not a dot is to be formed in the region (pixel region) on top of the medium corresponding to each pixel.

<Nozzle Arrangement>

Figure 2A:
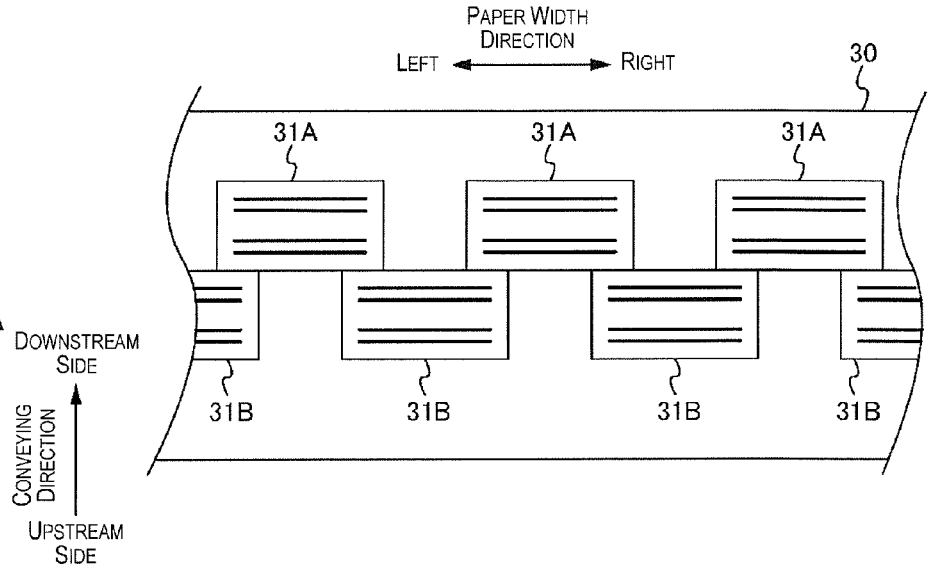
FIG. 2A is a diagram showing a layout of heads 31 provided in a head unit 30.
Figure 2B:
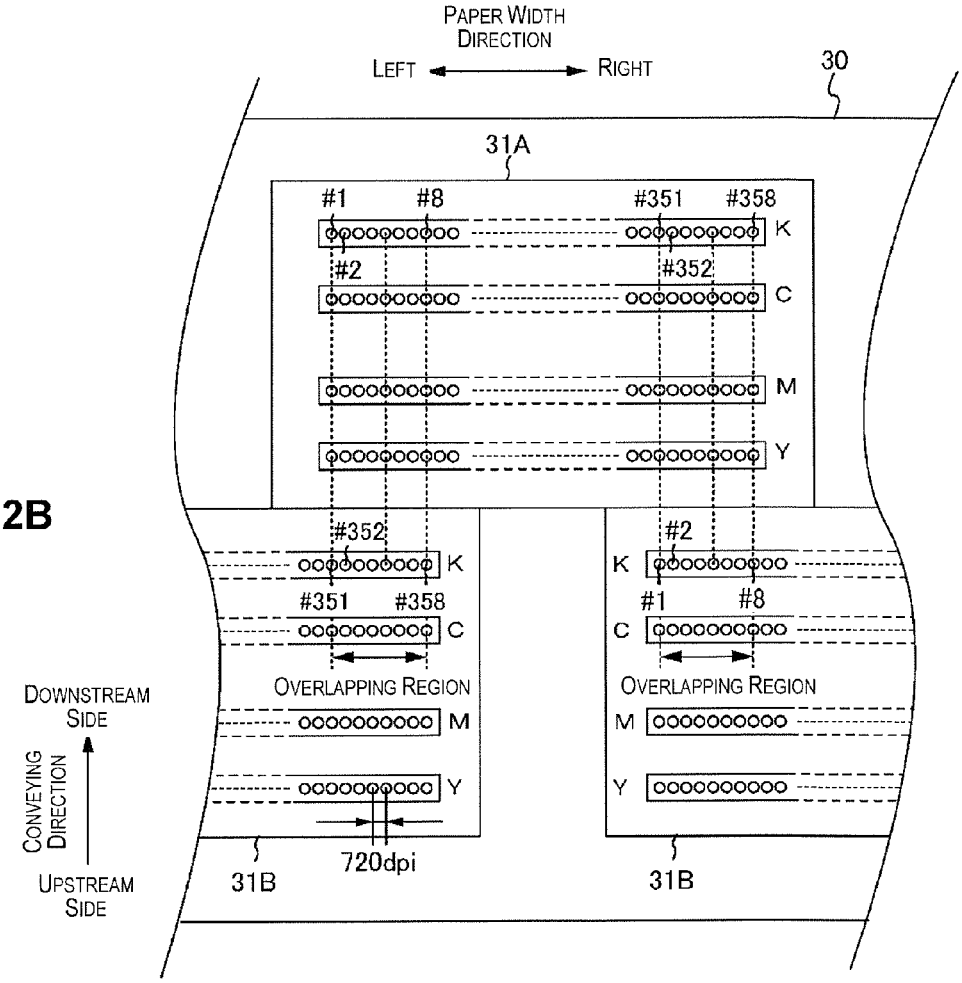
FIG. 2B is a diagram showing a nozzle layout on the bottom surface of the heads 31.

FIG. 2A is a diagram showing the layout of heads 31 provided in a head unit 30, and FIG. 2B is a diagram showing the nozzle layout on the bottom surface of the heads 31. In the printer 1 of the present embodiment, as shown in FIG. 2A, a plurality of heads 31 are arranged so as to be aligned in the paper width direction, which intersects the conveying direction, and the end portions of each head 31 are arranged so as to overlap. Heads 31A, 31B which are adjacent to each other in the paper width direction are arranged so as to be staggered in the conveying direction (in a zigzag pattern). Between the heads 31A, 31B that are adjacent to each other in the paper width direction, the head 31A which is downstream in the conveying direction is called the downstream head 31A, and the head 31B which is upstream in the conveying direction is called the upstream head 31B. The heads 31A, 31B that are adjacent to each other in the paper width direction are collectively called adjacent heads.

In FIG. 2B, the nozzles in the heads are viewed transparently from above. As shown in FIG. 2B, a black nozzle column K for ejecting black ink, a cyan nozzle column C for ejecting cyan ink, a magenta nozzle column M for ejecting magenta ink, and a yellow nozzle column Y for ejecting yellow ink are formed in the bottom surface of each head 31. Each nozzle column has 358 nozzles (#1 to #358). The nozzles in each nozzle column are aligned at a fixed interval (e.g., 720 dpi) in the paper width direction. The nozzles belonging to each nozzle column are numbered in ascending order from the left side in the paper width direction (#1 to #358).

The heads 31A, 31B aligned in the paper width direction are arranged so that eight nozzles overlap in the end portions of the nozzle columns in each head 31. More specifically, the eight nozzles (#1 to #8) on the left end of the nozzle columns in the downstream head 31A overlap with the eight nozzles (#351 to #358) on the right end of the nozzle columns in the upstream head 31B, and the eight nozzles (#351 to #358) on the right end of the nozzle columns in the downstream head 31A overlap with the eight nozzles (#1 to #8) on the left end of the nozzle columns in the upstream head 31B. As shown in the drawing, the portion of adjacent heads 31A, 31B with overlapping nozzles is called an overlapping region. The nozzles (#1 to #8, #351 to #358) belonging to an overlapping region are called overlapping nozzles.

The positions of overlapping nozzles in the end portions of heads 31A, 31B aligned in the paper width direction also coincide in the paper width direction. In other words, the positions of the nozzles in the end portion of the downstream head 31A in the paper width direction are equivalent to the positions of the corresponding nozzles in the end portion of the upstream head 31B in the paper width direction. For example, the position in the paper width direction of nozzle #1 at the far left end of the downstream head 31A is equal to the position in the paper width direction of the eighth nozzle #351 from the right of the upstream head 31B, and the position in the paper width direction of the eighth nozzle #8 from the left of the downstream head 31A is equal to the position in the paper width direction of nozzle #358 at the far right end of the upstream head 31B. Also, the position of nozzle #358 at the far right in the downstream head 31A is equal to the position of the eighth nozzle #8 from the left in the upstream head 31B, and the position of the eighth nozzle #351 from the right in the downstream head 31A is equal to the position of the nozzle #1 on the far left in the upstream head 31B in the paper width direction.

Arranging a plurality of heads 31 in the head unit 30 thus allows the nozzles to be aligned at equal intervals (720 dpi) along the entire paper width direction. As a result, rows of dots can be formed along the paper width in which the dots are aligned at equal intervals (720 dpi).

Figure 3:
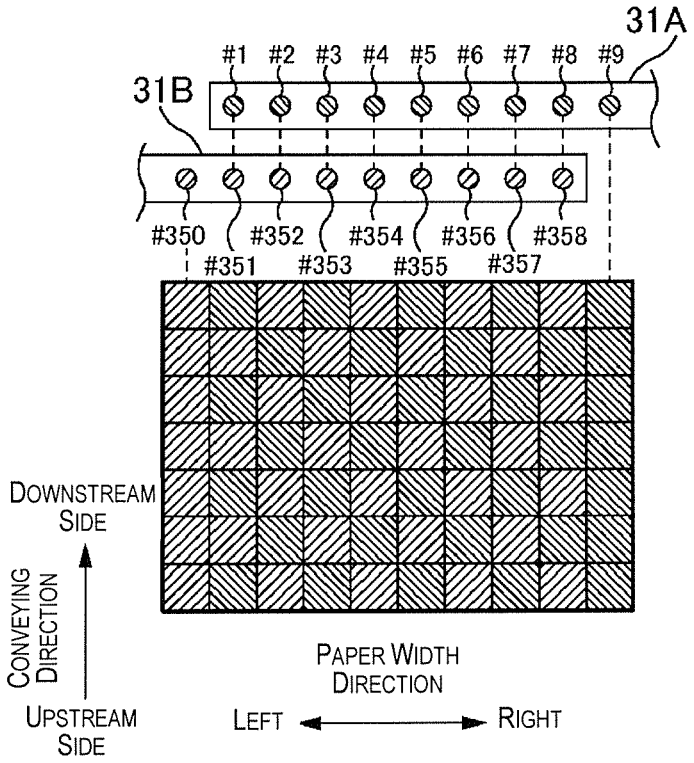
FIG. 3 is a diagram used to illustrate pixels formed by dots using the nozzles of the head unit.

FIG. 3 is a diagram used to describe pixels formed by dots using the nozzles of the head unit. A nozzle column from an upstream head 31B and a nozzle column from a downstream head 31A are shown in this drawing. Pixels formed by dots are shown configured as cells below these nozzles. In this drawing, the direction of the hatching assigned to each nozzle matches the direction of the hatching in the pixels with dots formed by these nozzles. As shown, the two nozzle columns share the formation of dots in the overlapping region.

<Printing Data Creation Process in a Comparative Example>

Figure 4:
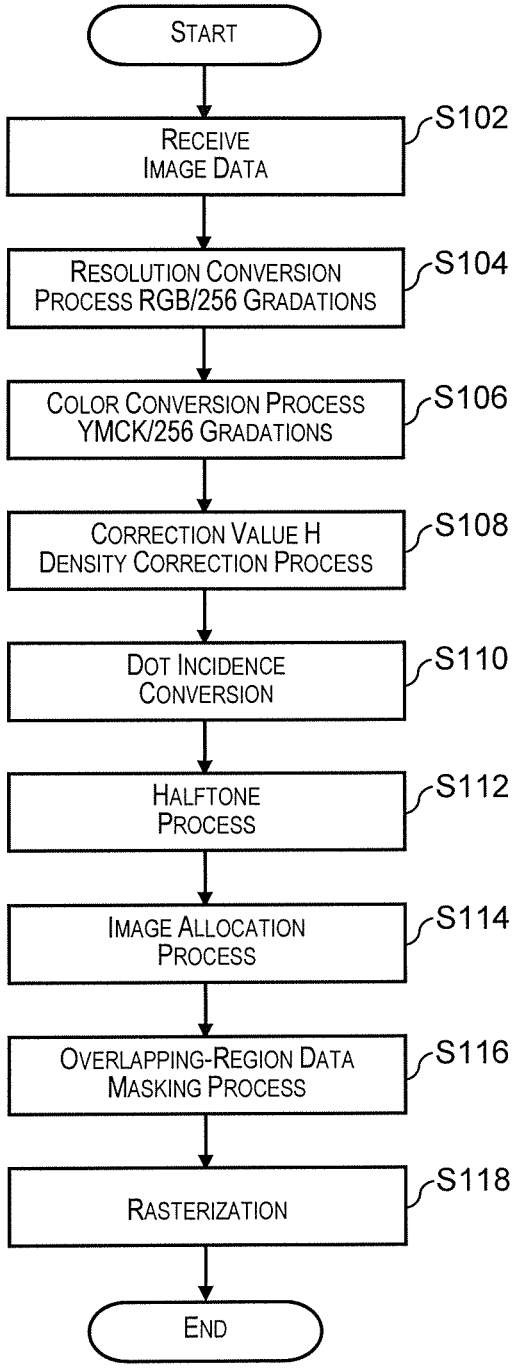
FIG. 4 is a flowchart of the printing data creation process in a comparative example.
Figure 5:
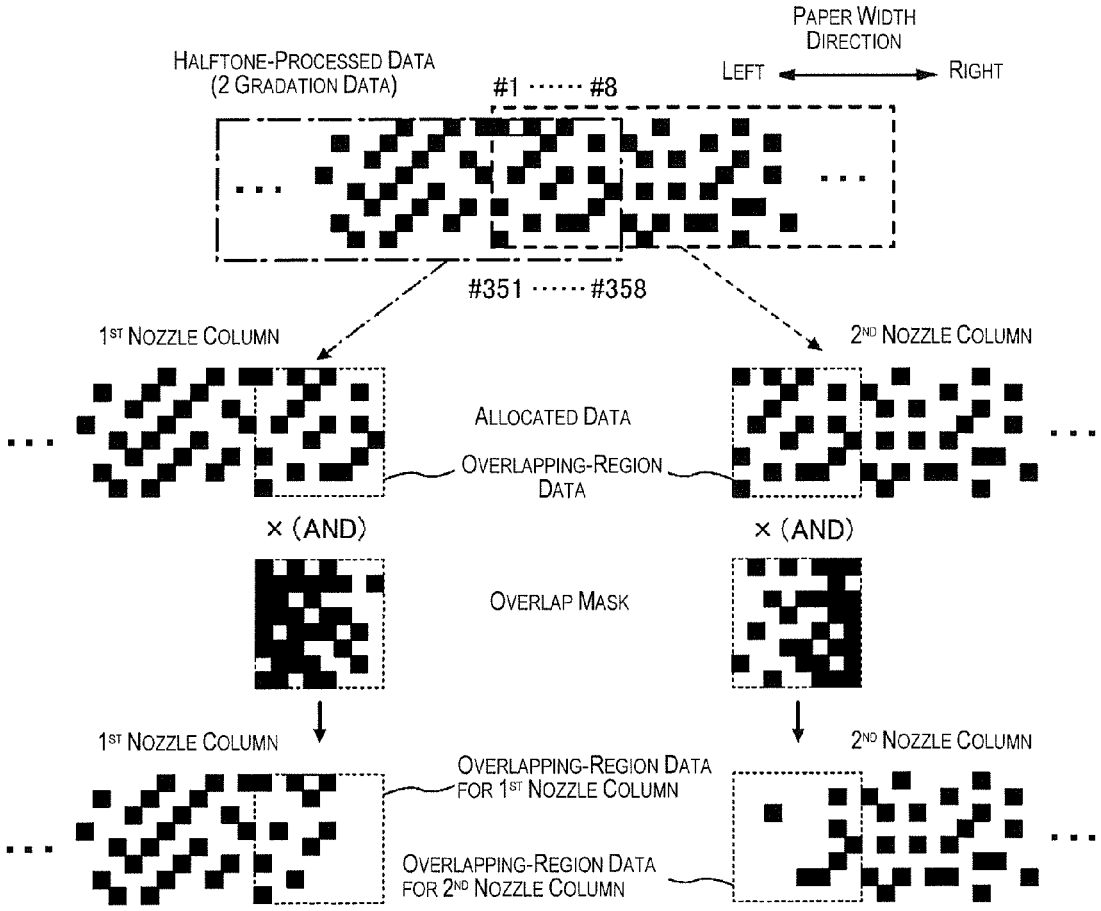
FIG. 5 is a diagram showing halftone-processed data corresponding to an overlapping region assigned to nozzle columns in an upstream head 31B and to nozzle columns in a downstream head 31A.
Figure 6:
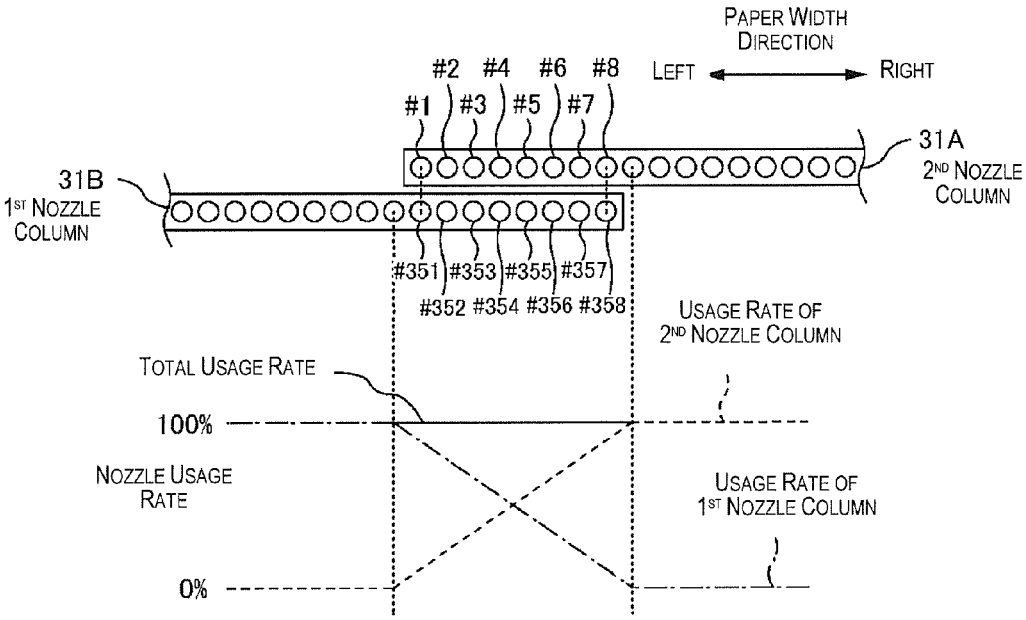
FIG. 6 is a diagram showing the usage rates of the first nozzle columns and the second nozzle columns.

FIG. 4 is a flowchart of the printing data creation process in a comparative example, FIG. 5 is a diagram showing halftone-processed data corresponding to an overlapping region assigned to nozzle columns in an upstream head 31B (referred to below as the first nozzle columns) and to nozzle columns in a downstream head 31A (referred to below as the second nozzle columns), and FIG. 6 is a diagram showing the usage rates of the first nozzle columns and the second nozzle columns. The following is an explanation of the printing data creation process (comparative example) embodying the printing method in the comparative example.

In the printing method in the comparative example, dots to be formed in the overlapping region to obtain the desired image density are formed by the overlapping nozzles in either the first nozzle column (upstream head 31B) or the second nozzle column (downstream head 31A). For example, as shown in FIG. 3, when dots are formed in all of the pixels assigned to the overlapping region by image data, the dots are formed by overlapping nozzles in either the first nozzle columns or the second nozzle columns. The printing data creation process for performing printing in this manner is indicated below. The printing data is created by a printer driver installed in a computer 50 connected to the printer 1.

As shown in FIG. 4, when the printer driver receives image data from various application programs (S102), a resolution conversion process is performed (S104). In the resolution conversion process, the image data received from the various application programs is converted to the resolution for printing on a medium S. The image data after resolution conversion processing is RGB data having 256 gradations (high gradation) expressed by the RGB color space. Therefore, the printer driver next performs color conversion processing, and the RGB data is converted to YMCK data corresponding to the inks in the printer 1 (S106). When the density irregularity correction value H has been set in the printer 1, the printer driver corrects the 256-gradation YMCK data using the correction value H (S108).

Figure 7:
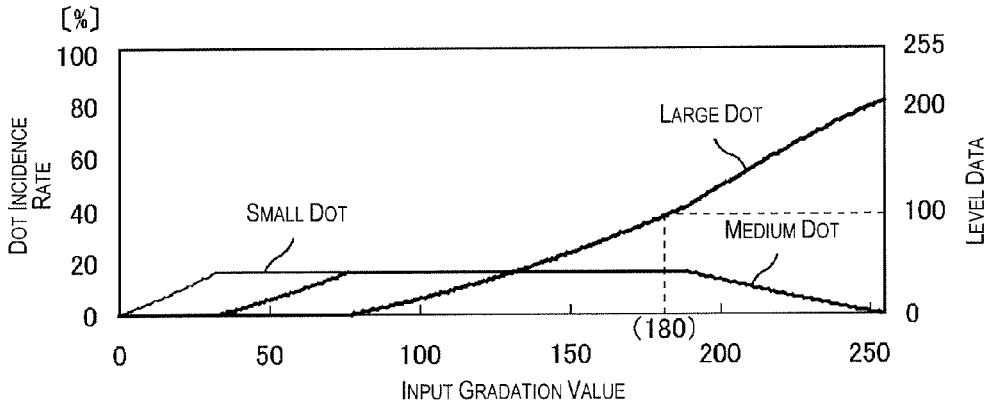
FIG. 7 is a diagram showing a dot incidence rate conversion table.

Next, the printer driver performs the dot incidence rate conversion processing (S108). FIG. 7 shows a dot incidence rate conversion table. In the dot incidence rate conversion process, the printer driver performs a conversion in which the gradation value in each of the pixels is referenced against the dot incidence rate conversion table, and the dot size and the incidence rate at which [the dot] is to be produced is determined. For example, in an instance in which the input gradation value (can be referred to simply as "gradation value" hereafter) is 180, it can be seen that a large dot is to be produced. It can also be seen that the incidence rate of the large dot is approximately 40%. Also shown is the level data corresponding to the dot incidence rate. Specifically, the level data can be regarded to be the dot incidence rate derived using 256 levels. It can be observed from FIG. 7 that a dot incidence rate of approximately 40% corresponds to a level data of 100.

There is also a region in which there is a switch between a large dot and a medium dot (input gradation values 75 through 255) and a region in which there is a switch between a medium dot and a small dot (input gradation values 0 through 255) when gradation value referencing has been performed; in such an instance, only a dot having a larger size is selected. Thus, a dot having one of the sizes is selected for each of the pixels, and level data (a dot incidence rate) for the corresponding size is obtained.

Next, the printer driver performs a halftone process (S110). In the halftone process, a dither mask (also referred to as a dither matrix) is applied, the level data described above is compared to the value of the cell in the dither mask, and it is decided that a dot is to be formed when the level data is greater than the cell value. When the level data is equal to or less than the cell value, it is decided that a dot is not to be formed. This halftone process makes it possible to obtain data indicating whether or not a dot is to be produced in each of the pixels in relation to every dot size.

Next, the printer driver performs an image allocation process (S114) to distribute the halftone-processed data to the overlapping nozzles (#351 to #358) in the first nozzle columns and the overlapping nozzles (#1 to #8) in the second nozzle columns. This distribution is performed according to dot size.

The data in the uppermost section of FIG. 5 indicates whether or not a large dot is to be formed after the halftone process. The black squares indicate a pixel in which a large dot is to be formed, and the white sections indicate pixels in which large dots are not to be formed. The data surrounded by the dashed lines is halftone-processed data allotted to the first nozzle columns, and data surrounded by the dotted lines is halftone-processed data allotted to the second nozzle columns. The overlapping surrounded halftone-processed data is halftone-processed data corresponding to the overlapping region.

The second section from the top of FIG. 5 shows data distributed to the first nozzle columns and the second nozzle columns by the printer driver. However, the overlapping region data surrounded by the dotted lines is data allotted to both the overlapping nozzles of the first nozzle columns and the overlapping nozzles of the second nozzle columns. When the data indicated in the second section from the top of FIG. 5 remains unaltered, the dots formed by the overlapping nozzles in the first nozzle columns and the dots formed by the overlapping nozzles in the second nozzle columns all overlap. Therefore, the printer driver decides which dots indicated by the overlapping region data (halftone-processed data) are to be formed by the overlapping nozzles in the first nozzle columns and which are to be formed by the overlapping nozzles in the second nozzle columns. Thus, the masking process (S116) is performed using the overlap mask indicated in the third section from the top of FIG. 5.

This masking process is performed by obtaining the logical product with the overlap mask. In other words, when the pixels indicated in black as distribution data in the pixels overlap with the pixels indicated in black in the overlap mask, medium-sized dots are generated in the pixels. The overlap mask used here is generated in accordance with the nozzle usage rate in FIG. 6. The overlap mask reduces the dot formation rate in the end portions of the nozzle columns.

After the pixel dots have been identified for the pixels to be formed by each nozzle column in the masking process (S116) for the overlapping region data, the printer driver performs rasterization to sort the matrix-shaped image data into the order in which it is to be transferred to the printer 1 (S118). The data processed in this manner is then sent by the printer driver to the printer 1 along with command data corresponding to the printing method. The printer 1 then performs printing on the basis of the received printing data.

The printing including the overlapping region can be performed on the basis of the image data obtained in this manner. However, the halftone process and the dot distribution process described above are performed independently. Thus, there is no relationship between the dispersion of the dots in the halftone process and the dispersion of the dots in the masking process, and deterioration occurs in the dispersion of dots in the overlapping region. As a result, deterioration occurs in the dispersion of dots in the overlapping region. Dispersion of the dots in the overlapping region between heads is improved by the embodiment described below.

Embodiment

Figure 8:
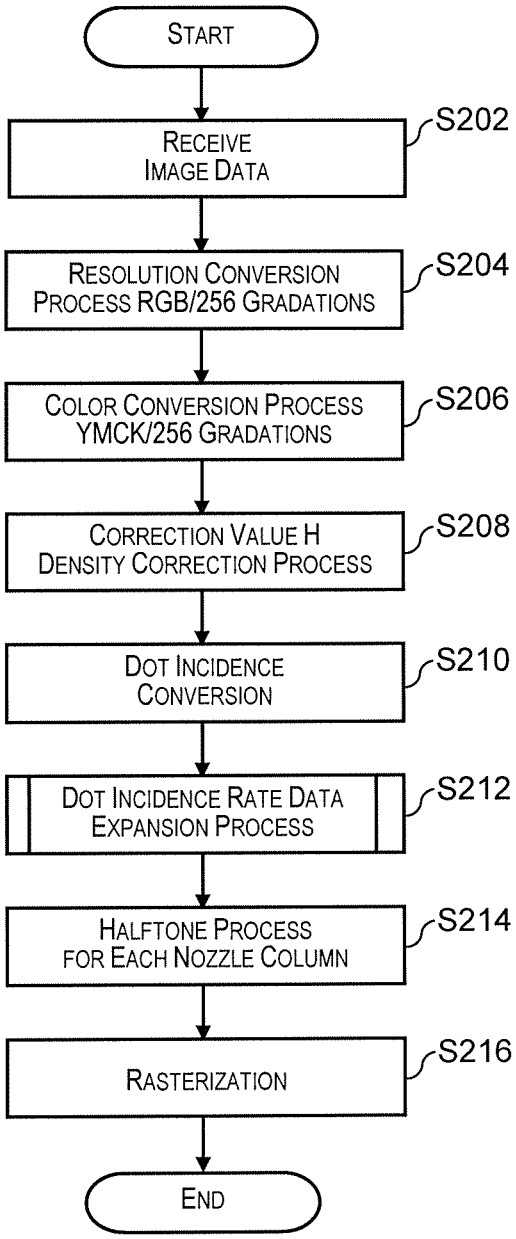
FIG. 8 is a flowchart of the creation of printing data in an embodiment.

FIG. 8 is a flowchart of the creation of printing data in an embodiment. When a printer driver inside a computer 50 connected to a printer 1 receives image data from application software (S202), as in the printing data creation process of the comparative example, resolution conversion processing (S204), color conversion processing (S206), density correction processing (S208, explained in greater detail below), and dot incidence rate conversion (S210) are performed.

Figure 9:
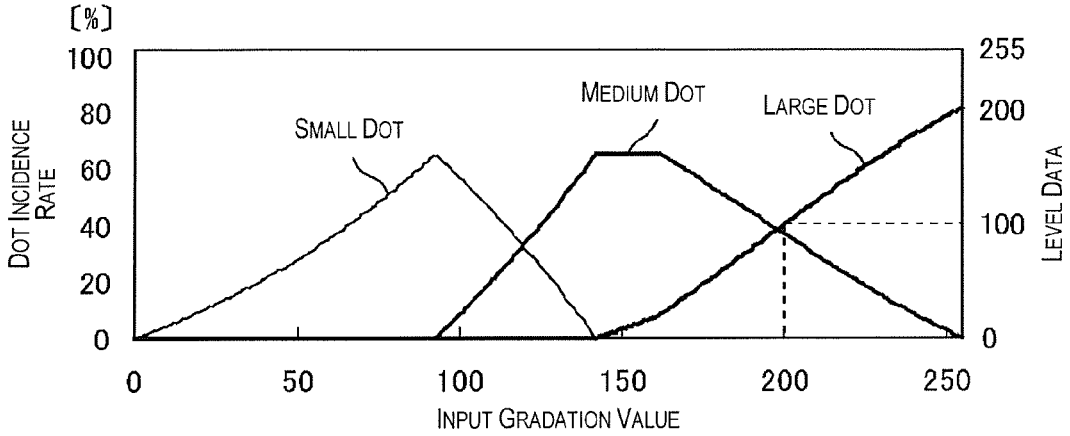
FIG. 9 is a diagram showing the dot incidence rate conversion table for overlapping regions in the embodiment.

FIG. 9 is a diagram showing the dot incidence rate conversion table for overlapping regions in the embodiment. In this embodiment, a different dot incidence rate conversion table is used for the overlapping region and the non-overlapping region. In this embodiment, the dot incidence rate conversion table shown in FIG. 7 as mentioned above is used in the non-overlapping region. Also, the dot incidence rate conversion table in FIG. 9 is used in the overlapping region.

When the dot incidence rate conversion table in FIG. 7 is compared with the dot incidence rate conversion table in FIG. 9, the dot incidence rate conversion table for the overlapping region in FIG. 9 is clearly the table in which smaller dots are more likely to occur. Image quality is improved when smaller dots occur in the overlapping region.

Figure 10:
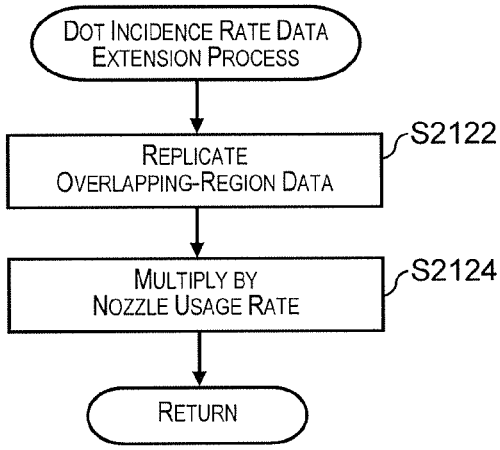
FIG. 10 is a flowchart of dot incidence rate data extension processing.
Figure 11:
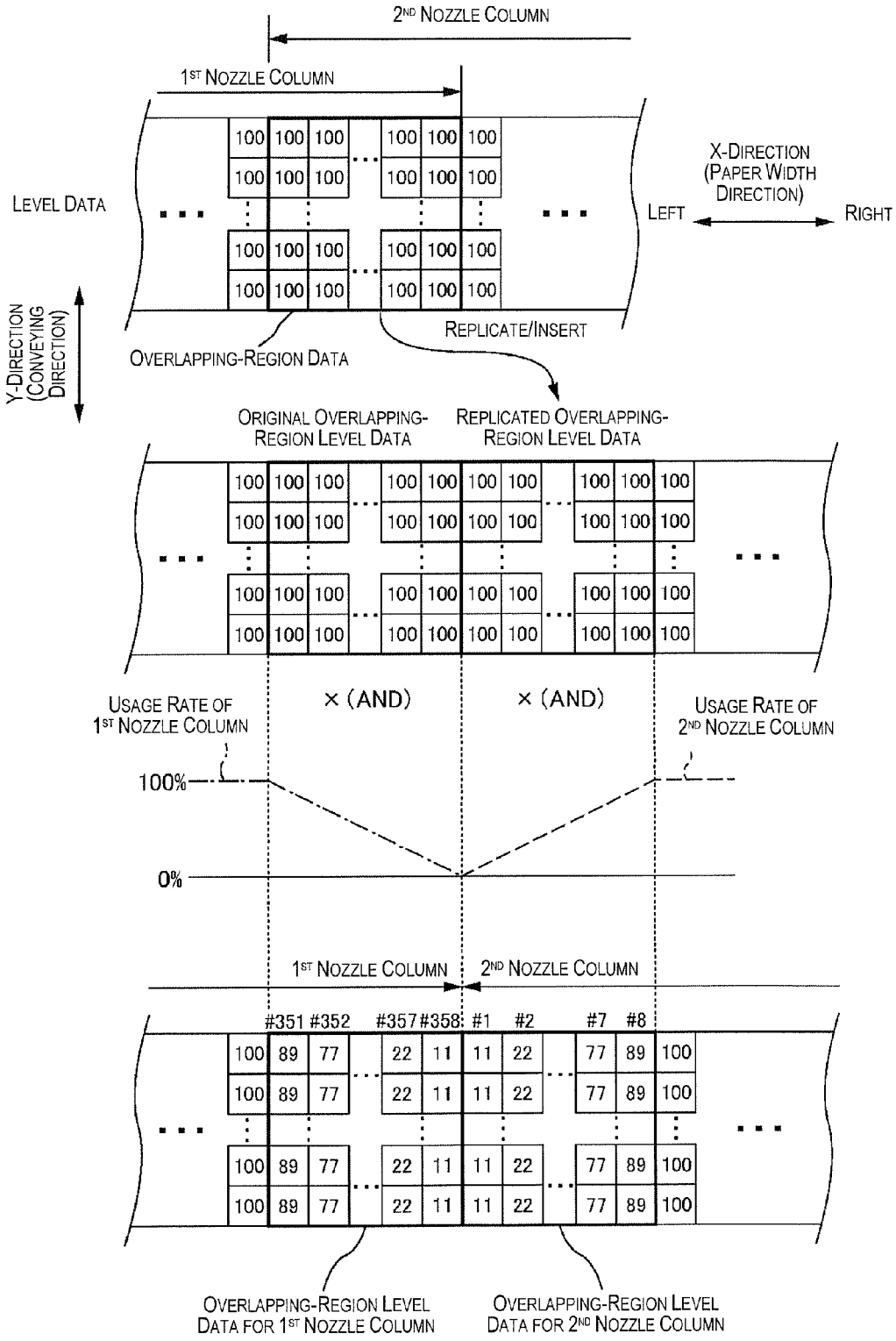
FIG. 11 is a diagram showing the replication of overlapping region data and the multiplication of the usage rate for each nozzle column by the overlapping region data.

Next, the printer driver performs a dot incidence rate data extension process (S212). FIG. 10 is a flowchart of the dot incidence rate data extension process. In the dot incidence rate data extension process, the data in the overlapping region is first replicated (S2122). FIG. 11 is a diagram showing the replication of overlapping region data and the multiplication of the usage rate for each nozzle column by the overlapping region data. The upper part of FIG. 11 shows the incidence rate of the level data obtained from the dot incidence rate conversion (S210) mentioned above.

Here, data is shown on the large dot incidence rate assigned to the first nozzle columns (the nozzle columns in the upstream head 31B) and to the second nozzle columns (the nozzle columns in the downstream head 31A). In this drawing, one square represents a single pixel, and the number recorded in a pixel is the large dot level data for the pixel.

Here, for ease of explanation, values for level data corresponding to the large dot incidence rate are indicated in each corresponding pixel. However, small dots and middle-sized dots are also generated during dot incidence rate conversion. Also, for ease of explanation, the level data for large dots in all of the pixels is 100 (and 200 is used as the inputted gradation value).

In addition, the pixels (data) surrounded by thick lines are the overlapping region data corresponding to the overlapping region of the first nozzle columns and the second nozzle columns. In the image data, the direction corresponding to the paper width direction is the X direction, and the direction corresponding to the conveying direction is the Y direction. The printer driver replicates the overlapping region data. As a result, the data in the second section from the top of FIG. 11 is two sets of overlapping region data aligned in the X direction.

Next, the printer driver multiplies the usage rate of each nozzle column by the two sets of overlapping region data (S2124). The data in the bottom level of FIG. 11 is the result of multiplying the usage rate of each nozzle column by the overlapping region data.

The nozzle usage rate in this embodiment changes depending on the location of the overlapping nozzles. As shown in the third section from the top of FIG. 11, the usage rate in the first nozzle columns among the overlapping nozzles is high on the first nozzle column side (left side) and gradually becomes lower. The usage rate in the second nozzle columns among the overlapping nozzles is low on the first nozzle column side (left side) and gradually becomes higher. When the usage rate of the first nozzle columns and the usage rate of the second nozzle columns are totaled, the usage rate is 100%.

For example, there is data in which the far left pixels (column) in the original overlapping region are assigned to nozzle #351 in the first nozzle column, and there is data in which the far left pixels (column) in the replicated overlapping region are assigned to nozzle #1 in the second nozzle column. The usage rate for nozzle #351 in the first nozzle column is 89%, the usage rate for nozzle #1 in the second nozzle column is 11%, and the level data for the pixels before distribution is 100. Here, as shown in the bottom level of FIG. 11, the level data assigned to nozzle #351 in the first nozzle column is 89, and the level data assigned to nozzle #1 in the second nozzle column is 11. By changing the usage rate in accordance with the location of the overlapping nozzle, printing can be performed so that the difference in density between the image formed in the overlapping region and the image formed in the non-overlapping region is insignificant.

When the multiplication processing for the nozzle usage rate has been completed (S2124), halftone process is next performed on each nozzle column (S214).

FIG. 12A is a diagram showing a dither mask, and FIG. 12B is a diagram showing the halftone process using dithering. Dithering is a method in which the size relationship between the thresholds stored in a dither mask and the level data indicated for each pixel is used as a basis to determine whether or not a dot is to be formed. Dithering can be used to generate dots at a density in accordance with the level data indicated by the pixel for each of the units region assigned by a single dither mask. Dithering can also be used to improve the graininess of an image by dispersing and generating dots using the established thresholds in the dither mask.

FIG. 12B shows the positions assigned by the dither mask (thick line) for the non-overlapping region and overlapping region of the first nozzle column and the second nozzle column. The printer driver assigns a dither mask to the high-gradation-level data (256 gradations) in sequence from the left side in the X direction and from the upper side in the Y direction, compares the denoted pixel with the threshold in the dither mask corresponding thereto, and determines whether or not a large dot is to be formed. After deciding whether or not dots are to be formed in a 256×256 pixel area of the two-dimensional level data at the upper left, the printer driver decides whether or not dots are to be formed in a 256×256 pixel area to the right of the determined pixels in the X direction. When it has been determined whether or not dots are to be formed in the entire region of the two-dimensional level data in the X direction, the printer driver determines whether or not dots are to be formed in sequential order from the left side in the X direction for the pixels below the 256th pixel from the top in the Y direction.

FIG. 12B shows the position of the dither mask assigned to 256 pixels in the X direction and in the Y direction from the pixel in the overlap data region of the first nozzle column that is second from the left and first from the top (the pixel corresponding to nozzle #352). The printer driver, for example, compares threshold 1 at the upper left of the dither mask with the level data 77 indicated by the pixel corresponding thereto. In this case, the printer driver determines that a large dot is to be formed because the level data indicated by the pixel is greater than the threshold.

The description given above related to large dots. However, as shall be apparent, the same processing can be performed related to small dots and medium-sized dots. The dither mask shown in FIG. 12A is 256×256 pixels. However, a 16×16 pixel dither mask can also be used. A description was also given in regard to a method in which the halftone process is performed using a typical dither mask. However, the dither mask (dither matrix) used in this embodiment, as described below, is preferably a variation-suppressing dither mask. The halftone process method is the same as above even when a variation-suppressing dither mask is used.

Last, rasterization is performed (S216). Rasterization uses the same method as the comparative example described above. The data processed in this manner is then sent by the printer driver to the printer 1 along with command data corresponding to the printing method. The printer 1 then performs printing on the basis of the received printing data.

It is thereby possible to not perform the masking process after the halftone process. Because the halftone process is performed after the nozzle usage rate is multiplied by the level data in the first nozzles and the second nozzles, the deterioration in graininess in the overlapping regions between heads can be minimized. Also, because a variation-suppressing dither mask (described below) is used during the halftone process, the fluctuation in the amount of dot derivation in each raster line can be minimized.

Figure 13:
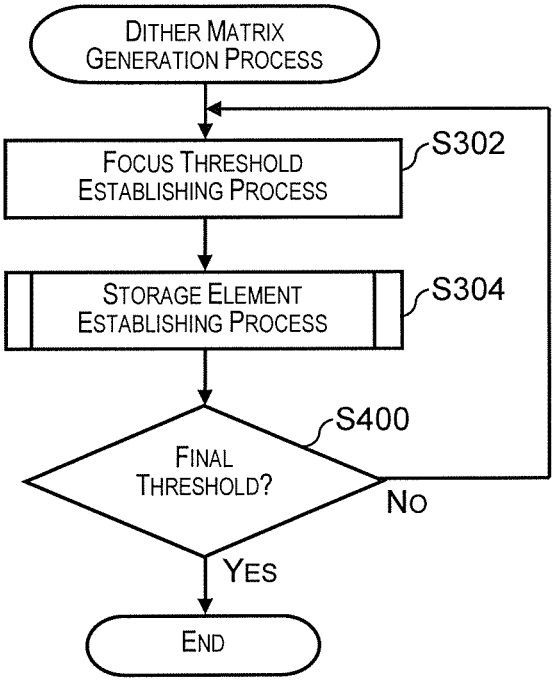
FIG. 13 is a flowchart showing the processing routine in the dither matrix generation method used in the embodiment.

FIG. 13 is a flowchart showing the processing routine in the dither matrix generation method used in this embodiment. In this example, for ease of description, a small 10×10 line dither matrix is generated. A graininess index (described below) is used as an evaluation of the optimality of the dither matrix.

The focus threshold decision processing is performed in Step S302. In the focus threshold decision processing, the threshold for making a storage element decision is determined. In this embodiment, the threshold is determined by selecting a threshold having a relatively small value, that is, a threshold is selected in sequential order from the thresholds of a value at which a dot readily forms. When selected in sequential order from the thresholds at which a dot is readily formed, the element stored in sequential order from the threshold for controlling the dot arrangement in a highlighted region with noticeable dot graininess is fixed. This can provide great design freedom for highlighted regions in which the dot graininess is noticeable.

The storage element establishing process is performed in Step S304. The storage element establishing process is performed to determine the element in which the focus threshold is stored. By alternately repeating the focus threshold decision processing (Step S302) and the storage element establishing process (Step S304), a dither matrix is generated. The target thresholds can be all of the thresholds or some of the thresholds.

Figure 14:
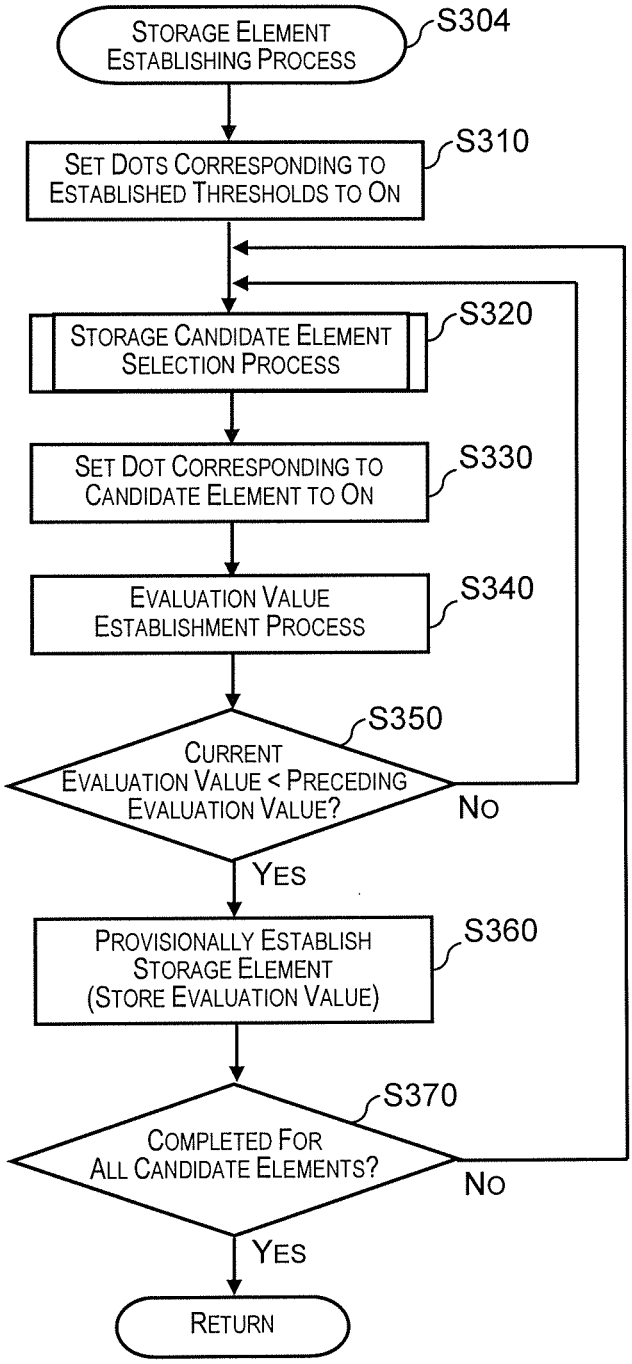
FIG. 14 is a flowchart showing the processing routine in the storage element decision processing.

FIG. 14 is a flowchart showing the processing routine in the storage element decision processing. In Step S310, the dots corresponding to the established threshold are turned on. By "established threshold" is meant the threshold determined by the storage element. Because the selection in this embodiment is made in sequential order from thresholds of a value at which a dot will readily form, as mentioned above, when a dot is formed at the focus threshold, a dot has to be formed in a pixel corresponding to an element in which the established threshold is stored. In contrast, for the smallest inputted gradation value at which a dot is formed in the focus threshold, a dot will not be formed in a pixel corresponding to an element other than an element in which the established threshold is stored.

FIG. 15 a drawing used to illustrate a matrix MG24 showing a scheme in which the first 25 thresholds (0 through 24) for which a dot is most readily formed are stored in a matrix, and to illustrate a scheme in which a dot is formed on each of 25 pixels corresponding to those elements. A dot pattern Dpa so constituted is used to determine in which pixel the 26th dot is to be formed.

The storage candidate element selection process is performed in Step S320. In the storage candidate element selection process, a storage candidate is selected so that the variation in the number of dots formed in the printing element group is not excessive.

Figure 16:
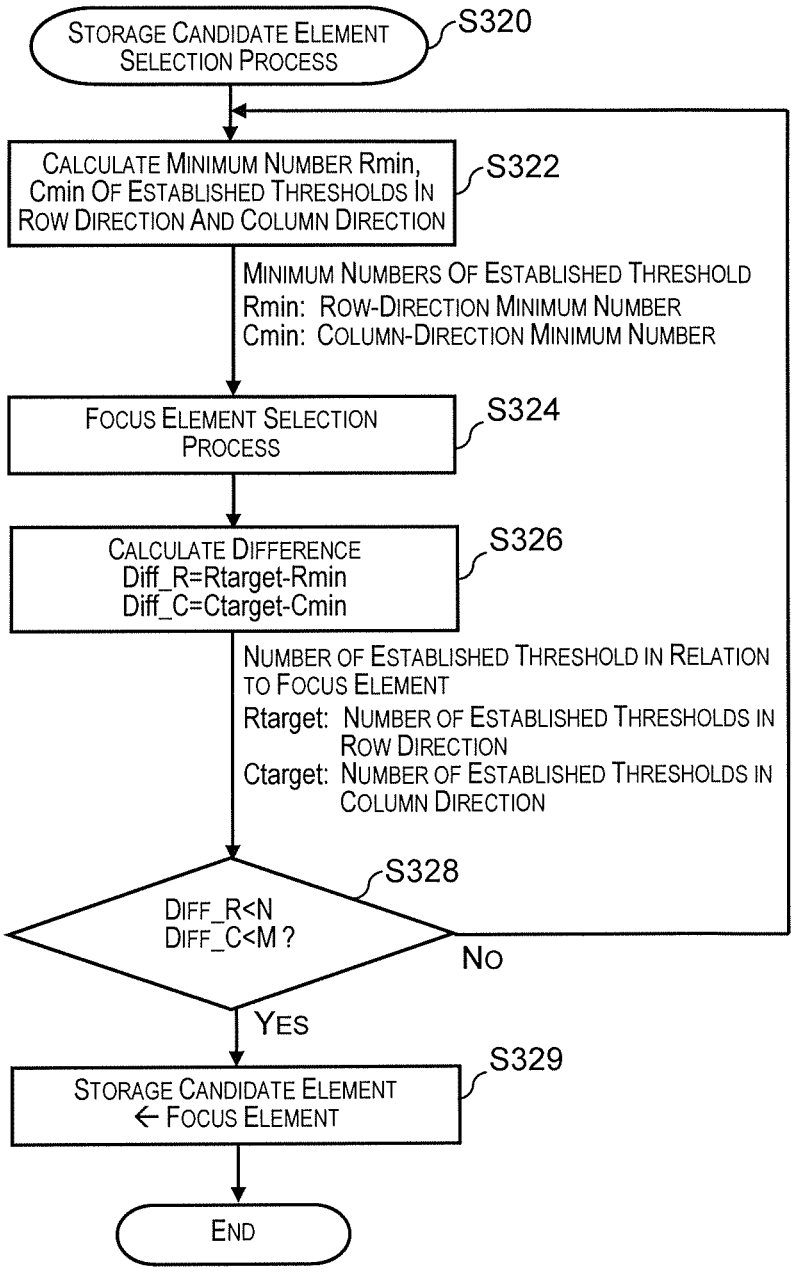
FIG. 16 is a flowchart showing the processing routine of the storage candidate element selection process.

FIG. 16 is a flowchart showing the processing routine of the storage candidate element selection process. In Step S322, the minimum row direction number Rmin, which is the minimum number of established thresholds in the row direction of the dither matrix M, and the minimum column direction number Cmin, which is the minimum number of established thresholds in the column direction, are calculated.

Figures 17, 18:
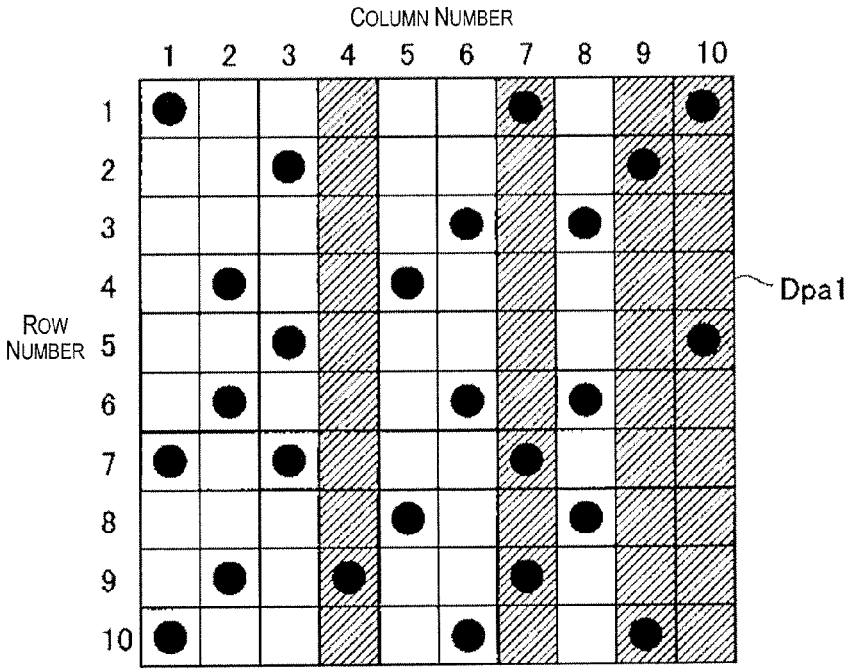

FIG. 17 is a descriptive diagram showing the row-direction established threshold numbers and the column-direction established threshold numbers. It is clear from FIG. 17 that, for example, the three thresholds 17, 19, and 12 are stored in each element of the first column, and only the one threshold 16 is stored in each element of the fourth column. Meanwhile, for example, the three thresholds 17, 7, and 14 are stored in elements of the first row, and the two thresholds 1 and 24 are stored in elements of the second row. Threshold 1 in the fourth column is determined to be the minimum column direction number Cmin, and threshold 2 in the second row is determined to be the minimum row direction number Rmin, on the basis of the various established thresholds.

The focus element selection processing is performed in Step S324. In the focus element selection processing, the storage element not storing the established thresholds are selected in a predetermined order. In this embodiment, they are selected in order by column from the first column. For example, the initial focus element that is selected as the focus element is the first row/second column element to which *1 has been affixed. Then, first row/third column (*2), and first row/fourth column (*3) are selected.

A difference calculation process is performed in Step S326. In the difference calculation process, a calculation is made of the column direction difference value Diff_C between the column direction established threshold number Ctarget and the column direction minimum number Cmin and the row direction difference value Diff_R between the row direction minimum number Rmin and the row direction established threshold number Rtarget to which the focus element belongs. For example, when the focus element is the element in the first row and second column, the row direction established threshold number Rtarget is 3, and the row direction minimum number Rmin is 2. Therefore, the row direction difference value Diff_R is 1. Meanwhile, the column direction established threshold number Ctarget is 3, and the column direction minimum number Cmin is 1. Therefore, the column direction difference value Diff_C is 2.

In Step S328, it is decided whether both the row direction difference value Diff_R and the column direction difference value Diff_C are less than predetermined reference values. When the result of the decision is that the row direction difference value Diff_R is less than reference value N and the column direction difference value Diff_C is less than reference value M, the process advances to Step S329. When either one is greater than its reference value, the process returns to Step S322. For example, when the two reference values N, M are both 1, the elements in the first row/second column and first row/third column are clearly greater than the reference value, but the element in the first row/fourth column is less than the reference value.

In Step S329, the focus element is replaced by a storage candidate element. In this way, it is selected as a storage element only when the difference between the established threshold numbers in the row and column to which the focus element belongs and the minimum value of the established threshold numbers in the row and column is less than the predetermined reference value. More specifically, only the elements (cross-hatched elements) belonging to the fourth column, seventh column, ninth column, and tenth column, irrespective of the row number, are selected as a storage candidate elements. When the processing in Step S329 has been completed, the processing returns to Step S330 (FIG. 14).

In Step S330, the dots corresponding to the storage candidate elements are turned on. In Step S310, this processing is performed in a form in which the turned on dots corresponding to the established thresholds are added to a dot group.

FIG. 18 is a descriptive diagram showing a scheme (dot pattern Dpa1) in which the dots corresponding to the storage candidate elements and the dots corresponding to the established thresholds have been turned on. Here, the storage candidate element is the element in the first row and seventh column. FIG. 19 is a descriptive diagram used to illustrate a matrix in which this state of formation of dots has been quantified, i.e., a dot density matrix Dda1 in which dot density is quantitatively represented. The number 0 means a dot is not to be formed, and the number 1 means a dot is to be formed (including instances in which it is assumed that a dot is to be formed in a storage candidate element).

In Step S340, an evaluation value establishment process is performed. In the evaluation value determination process, the graininess index is calculated as an evaluation value on the basis of the dot density matrix (FIG. 19). The graininess index can be calculated using the calculation equations described below.

In Step S350, the currently calculated graininess index is compared with the previously calculated graininess index (stored in a buffer not shown in the drawing). When the result of the comparison is that the currently calculated graininess index is small (preferred), the calculated graininess index in the buffer is linked to the storage candidate element and stored (updated), and the current storage candidate element is determined provisionally to be a storage element (Step S360).

This process is performed on all of the candidate elements, and finally the storage candidate element stored in the buffer (not shown) is determined (Step S370). All of the thresholds or all of the thresholds in a predetermined range are processed, and the generation of the dither matrix is completed (Step S400, FIG. 13).

Because the difference in the number of dots formed with each gradation value in each row and each column is limited to a predetermined range, local density irregularities are minimized, and image quality can be improved. Also, in this embodiment, because the density error in each raster line is reduced, a further advantage is presented in that the occurrence of banding can be minimized.

Figure 20A:
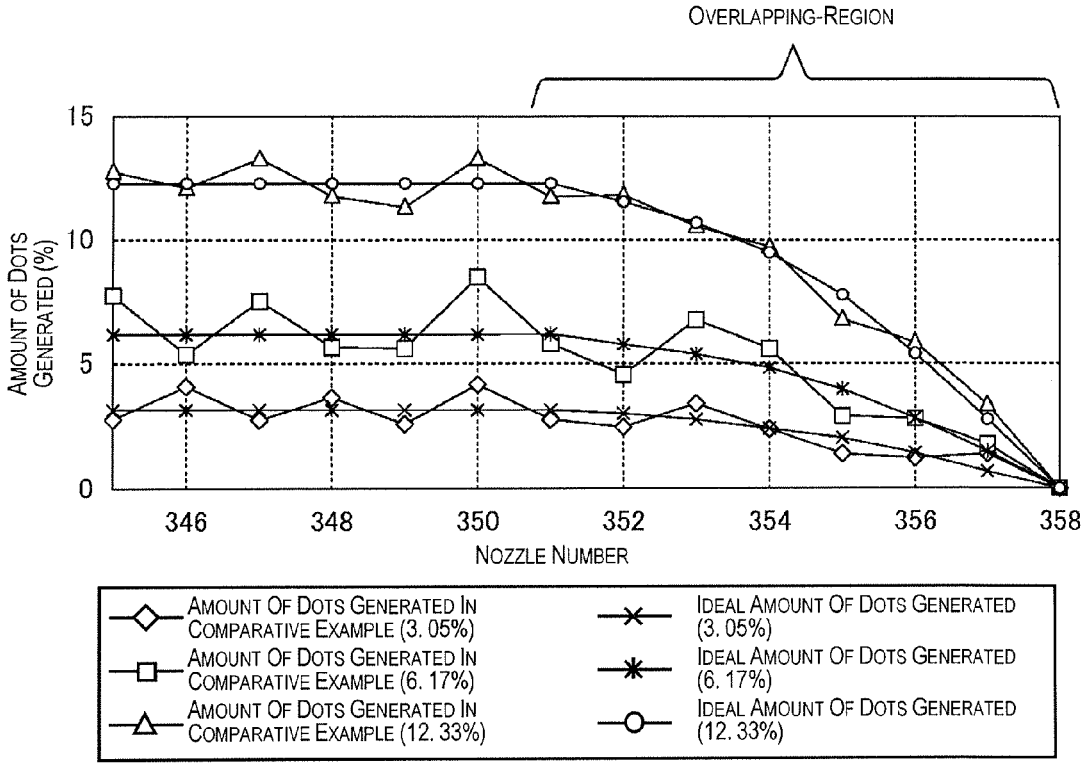
FIG. 20A is a graph showing the variation in the number of dots generated in overlapping regions of the comparative example.
Figure 20B:
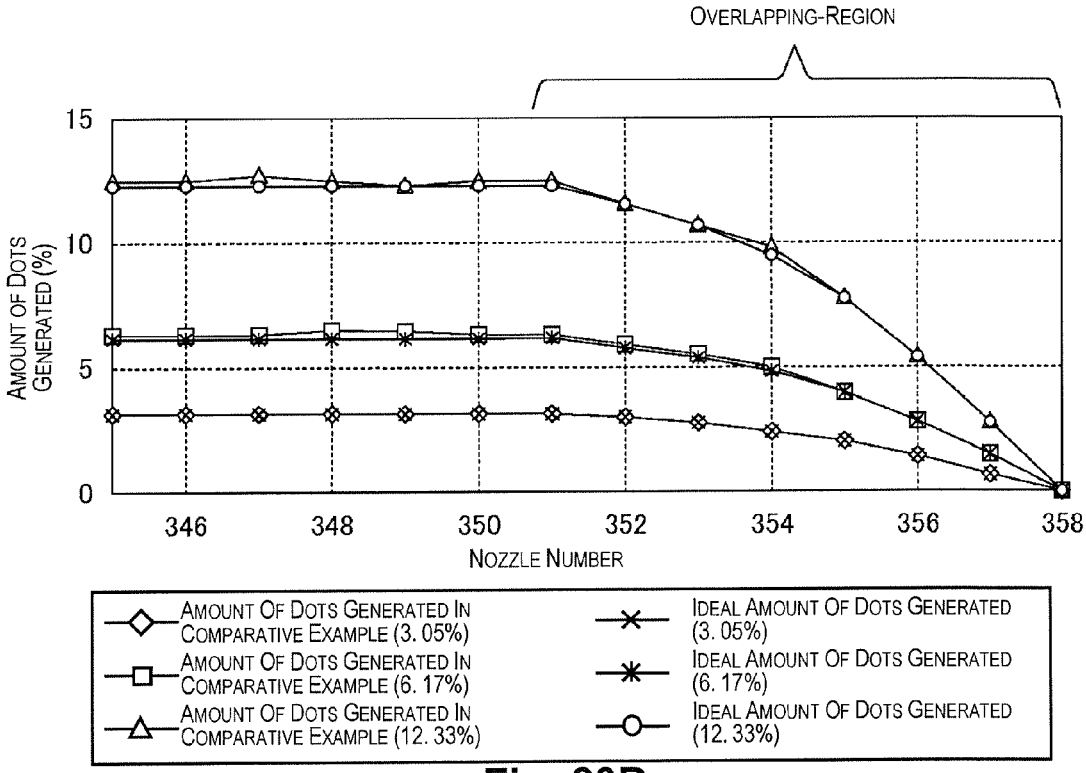
FIG. 20B is a graph showing the variation in the number of dots generated in overlapping regions of the embodiment.

FIG. 20A is a graph showing the variation in the number of dots generated in overlapping regions of the comparative example, and FIG. 20B is a graph showing the variation in the number of dots generated in overlapping regions of the embodiment. Image data was intentionally generated so the amount of dots generated would be as expressed by the percentages described below, and printing was performed in accordance with this image data. The graphs represent instances where the amount of dots generated was intentionally set to 3.05% and 6.17%, and the actual amount of dots generated when printing is performed at the 6.17% setting. The horizontal axis denotes the nozzle number. Nozzles #344 to #350 are the nozzles in the non-overlapping region, and nozzles #351 to #358 are in the overlapping region.

As is clear with reference to FIG. 20A, in the method of the comparative example, even when the amount of dots generated is defined as described above and printing is performed, the actual amount of dots generated differs from the ideal scheme due to the halftone process and the masking process performed after the halftone process, and the amount of the discrepancy varies.

In the method of the embodiment as shown in FIG. 20B, when the amount of dots generated is defined as described above and printing is performed, the amount of dots is closer to the defined amount than in the comparative example. It is particularly noteworthy that the amount of dots generated is close to the defined amount even in the overlapping region. In other words, even when printing of the overlapping region is divided between two nozzles, the discrepancy in the amount of dots generated in the overlapping region can be minimized. In other words, good dispersion can be maintained.

Figure 21:
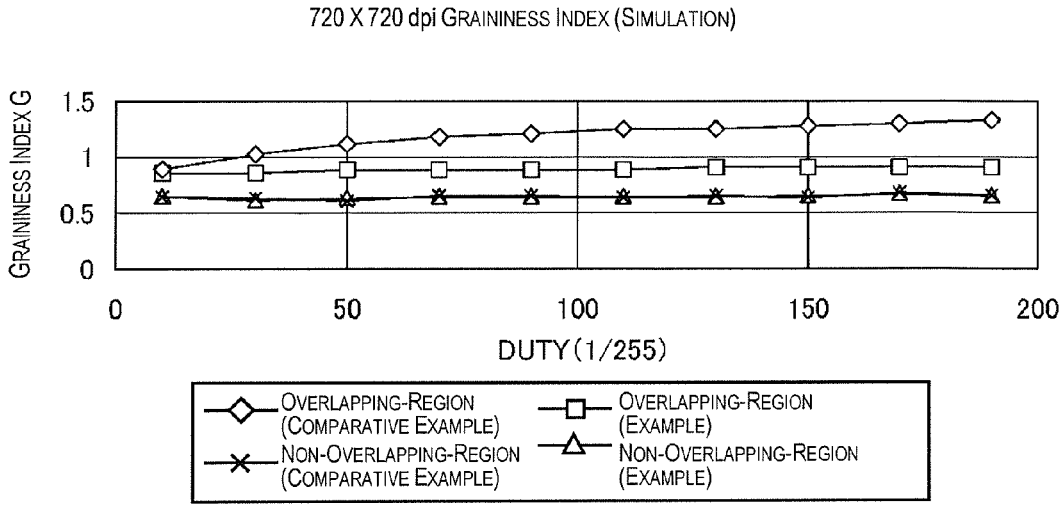
FIG. 21 is a graph showing the results of the graininess index in the comparative example and in the embodiment.

FIG. 21 is a graph showing the results of the graininess index in the comparative example and in the embodiment. The results in this drawing are simulated results. The graininess index quantifies the graininess.

If the visual transfer function (VTF) is used, the visual sensitivity of humans is modeled as a transfer function known as the visual transfer function, which can quantify the graininess of the dots after halftone process as they appear to the human eye. The quantified value is called the graininess index G. The following equation is a typical empirical equation expressing the visual transfer function VTF.

$$VTF(u) = 5.05 \cdot \exp\left(\frac{-1.38\pi L \cdot u}{180}\right) \cdot \left\{1 - \exp\left(\frac{-0.1\pi L \cdot u}{180}\right)\right\} \quad \text{[Equation 1]}$$

The variable L in this equation represents the observation distance, and the variable u represents the spatial frequency. This equation defines the graininess index. Coefficient K in the equation is the coefficient for matching the obtained value to human perception.

The graininess index G used in the equation above is expressed by the following equation. FS is the power spectrum obtained when a Fourier transform is performed on the obtained image.

$$G = K\int FS(u) \cdot VTF(u)du \quad \text{[Equation 2]}$$

The results determined using the equation above are shown in FIG. 21. As shown in the diagram, the horizontal axis is the duty value, which is obtained by multiplying the numerical value on the horizontal axis by (1/255). Here, a duty value of 1.0 is a duty value of 100%. A duty value of 100% is the value when all of the pixels have been filled with single-color ink. The vertical axis is the graininess index. In the above equation, a smaller graininess index means better graininess.

As shown, the graininess index in the non-overlapping region of the comparative example and the graininess index in the non-overlapping region of the embodiment is nearly the same value in the entire region. However, in the overlapping region, the graininess index of the embodiment was lower than that of the comparative example in the entire region. In other words, it is clear that the graininess in the overlapping region has been improved.

Thus, the method of the embodiment described above can also improve the graininess in the overlapping region.

The following is a description of the density correction processing. In order to describe this processing, the pixel region and the column region have to be defined. The column region is a region in which pixel regions have been aligned in the conveying direction. This corresponds to a plurality of pixels in the image data (a pixel column below) aligned in the X direction.

Figure 22:
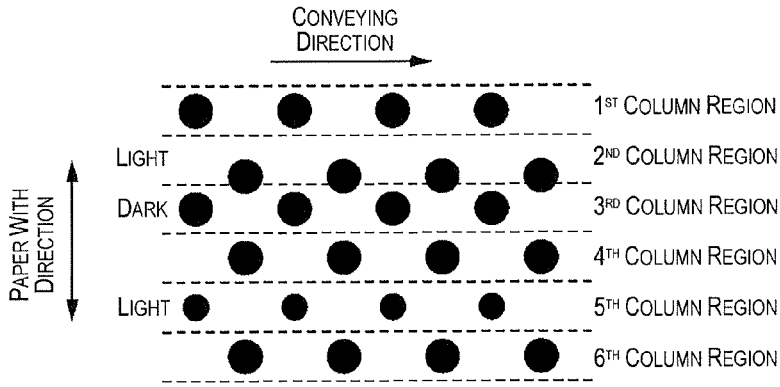
FIG. 22 is a diagram showing an example in which a given raster line has an impact on the density of adjacent raster lines.

FIG. 22 is a diagram showing an example in which a given raster line has an impact on the density of adjacent raster lines. In FIG. 22, the raster line formed in the second column region has ink droplets that have been deflected after being ejected from the nozzles and have been formed near the third column region. As a result, the second column region appears light, and the third column region appears dark. Also, the amount of ink droplets ejected in the fifth column region is less than the defined amount, and the dots formed in the fifth column region are smaller. As a result, the fifth column region is light. The density in the image appears to be irregular. Therefore, the lightly printed column regions are corrected so as to be printed darkly, and the darkly printed column regions are corrected so as to be printed lightly. Also, the reason the third column region is dark is not because of the effect of the nozzles assigned to the third column region, but because of the effect of the nozzles assigned to the adjacent second column region.

Thus, in the density correction processing, the correction value H is calculated for each column region (pixel column) so as to take into account the effect of adjacent nozzles. The correction value H can be calculated based on the model of printer 1 when the printer 1 is manufactured or being maintained. Here, the correction value H is corrected in accordance with a correction value acquiring program installed in a computer 50 connected to the printer 1. The following is an explanation of the specific calculation method for the correction values in each column region.

Figure 23:
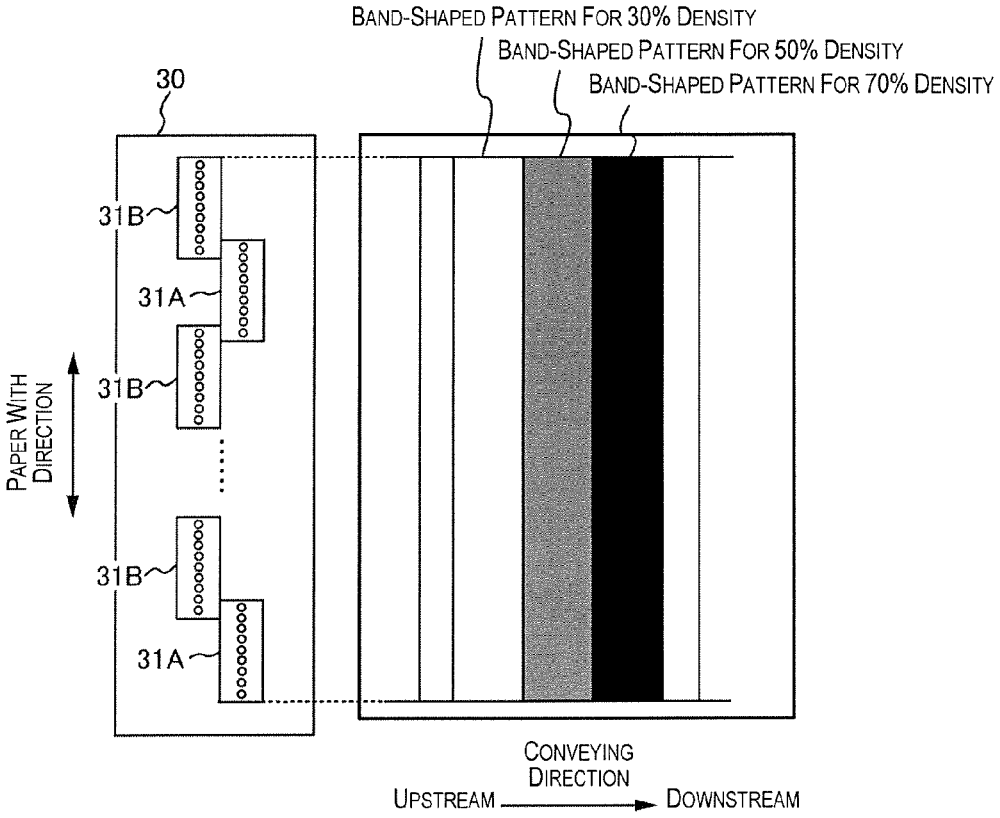
FIG. 23 is a diagram showing a test pattern.

FIG. 23 is a diagram showing the test pattern. The correction value acquisition program first prints a test pattern using the printer 1. In this drawing, the correction pattern is formed by one nozzle column among the nozzle columns (YMCK) in each head 31. The test pattern is a correction pattern printed for each nozzle column (YMCK).

A correction pattern is composed of band-shaped patterns with three different densities. The band-shaped patterns are generated from image data with a fixed gradation value. The gradation values used to form the band-shaped patterns are called command gradation values. The command gradation value for a band-shaped pattern with a 30% density is Sa(76), the command gradation value for a band-shaped pattern with a 50% density is Sb(128), and the command gradation value for a band-shaped pattern with a 70% density is Sc(179). Also, a single correction pattern is composed of a raster line (column region) with a number of nozzles in a head unit 30 aligned in the paper width direction.

Even when printing data is created to print a correction pattern, as in the embodiment described above, the halftone process is performed on data in which the usage rate of the nozzles has been multiplied by the level data for each of the dot sizes.

Figure 24:
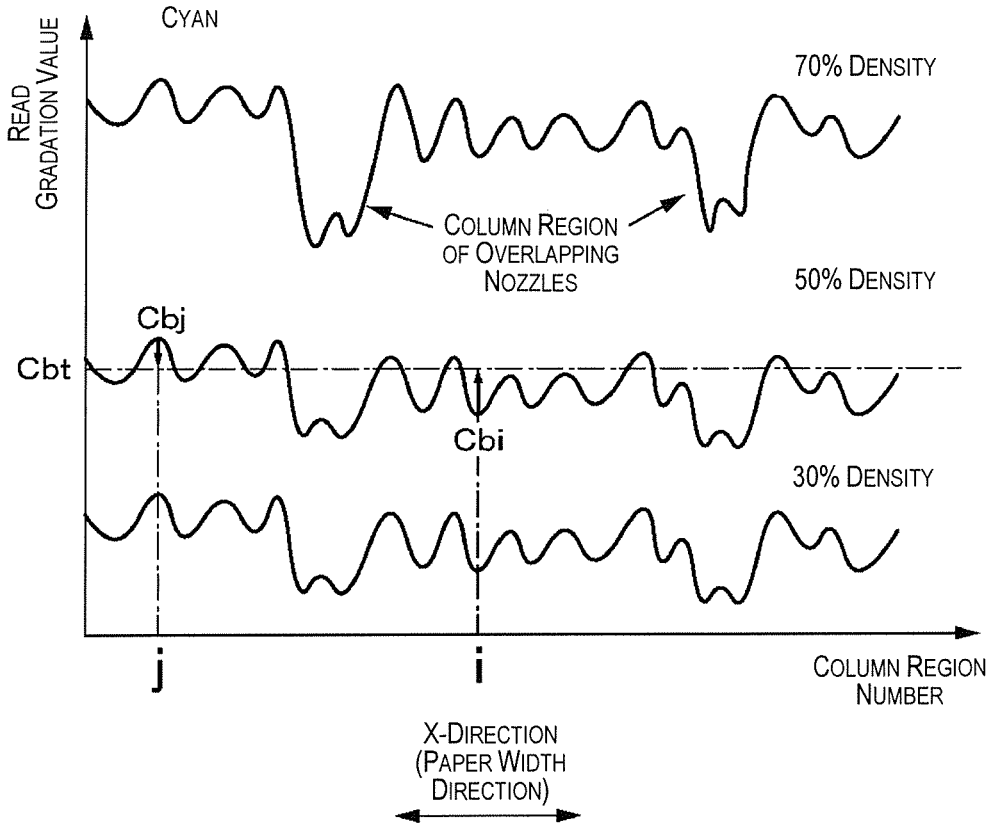
FIG. 24 is a graph showing the results when a correction pattern for cyan is read by a scanner.

FIG. 24 is [a graph showing] the results when a correction pattern for cyan is read by a scanner. Next, the correction value acquisition program acquires the results of the test pattern read by the scanner. The following is an explanation of an example of read data for cyan. The correction value acquisition program performs a one-to-one correspondence between the pixel columns in the read data and the column regions constituting the correction pattern, and calculates the density (read gradation value) for each column region. More specifically, the average value of the read gradation values of each pixel belonging to the pixel column corresponding to the column region is the read gradation value for the column region. In the graph shown in FIG. 24, the horizontal axis represents the column region number, and the vertical axis represents the read gradation value in each column region.

As shown in FIG. 24, for each band-shaped pattern a discrepancy arises in the read gradation value for each column region even though they are uniformly formed using the command gradation values. For example, in the graph shown in FIG. 24, the read gradation value Cbi for the column region i is somewhat smaller than the read gradation values for the other column regions, and the read gradation value Cbj for the column region j is somewhat larger than the read gradation values for the other column regions. In other words, the column region i appears to be light, and the column region j appears to be dark. The variation in the read gradation values for each column region is the concentration irregularity occurring in the printed image.

By bringing the read gradation values for each column region closer to a fixed value, density irregularity due to light overlapping region images and nozzle processing accuracy can be improved. When the command gradation value is the same (for example, Sb•50% density), the average value Cbt of the read gradation value in all of the column regions is set as target value Cbt. The gradation value indicating the pixel column data corresponding to each column region is then corrected so that the read gradation value for each column region with command gradation value Sb is near the target value Cbt.

More specifically, in FIG. 24, the gradation value indicating the pixel column data corresponding to column region i having a lower read gradation value than the target value Cbt is corrected to a gradation value darker than the command gradation value Sb. Meanwhile, the gradation value indicating the pixel column data corresponding to column region j having a higher read gradation value than the target value Cbt is corrected to a gradation value lighter than the command gradation value Sb. Thus, in order for the density in all column regions to approximate the same fixed gradation value, the correction value H is calculated to correct the gradation values of the pixel column data corresponding to each column region.

Figure 25A:
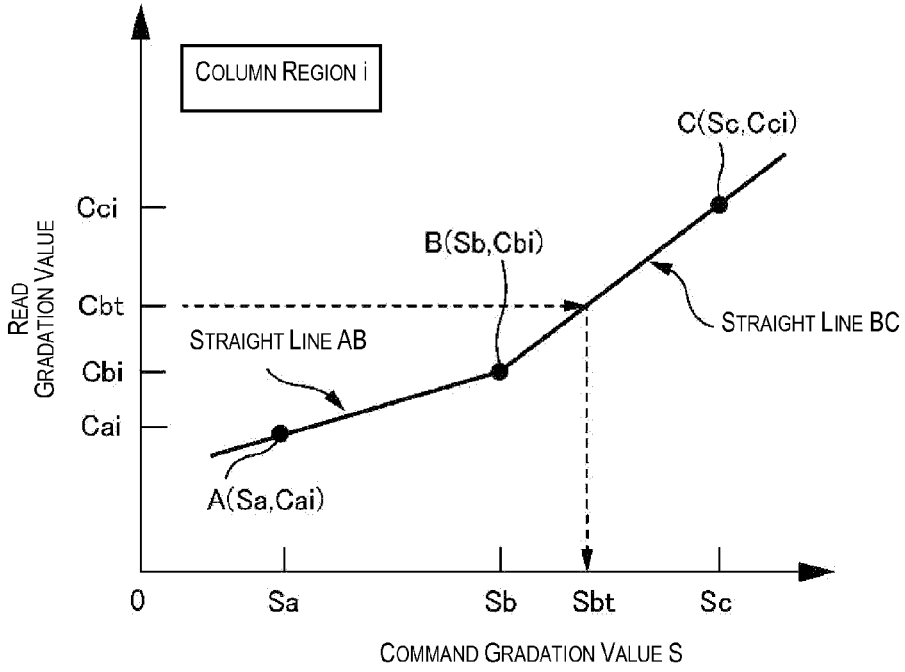
FIG. 25 is a diagram showing the specific calculation method for density irregularity correction values H.
Figure 25B:
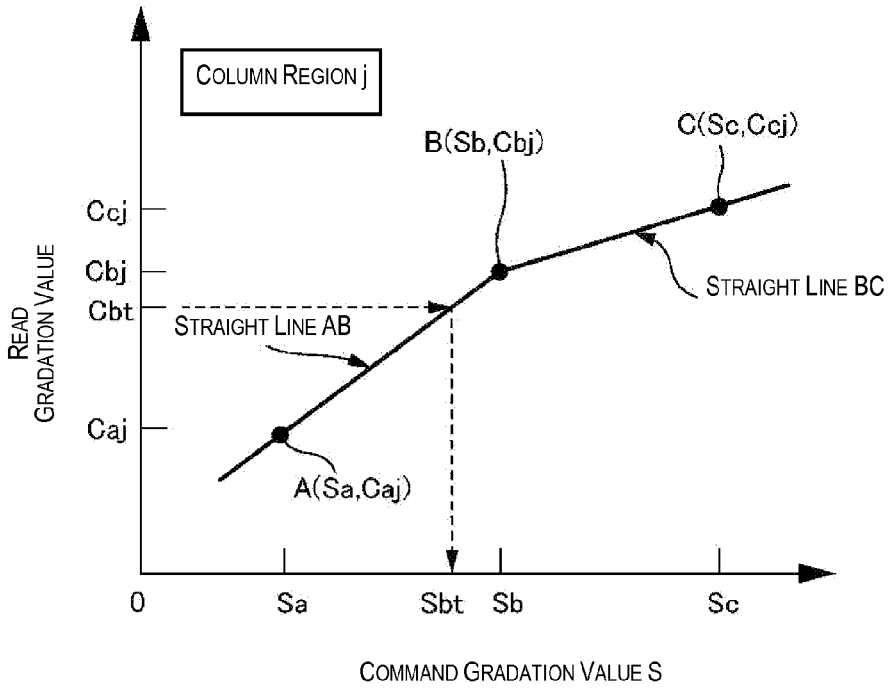

FIG. 25A and FIG. 25B are diagrams showing the specific calculation method for density irregularity correction values H. First, FIG. 25A shows the calculation of the target command gradation value (for example, Sbt) for the command gradation value (for example, Sb) in the column region i, which has a read gradation value lower than the target value Cbt. The horizontal axis represents the gradation value, and the vertical axis represents the read gradation value in the test pattern results. The read gradation values (Cai, Cbi, Cci) are plotted in relation to the command gradation values (Sa, Sb, Sc) in the graph. For example, the target command value Sbt for representing the target value Cbt in relation to command gradation value Sb in the column region i is calculated using the following equation (linear interpolation based on line BC).

$$Sbt=Sb+\{(Sc-Sb)\times(Cbt-Cbi)/(Cci-Cbi)\}$$

Similarly, as shown in FIG. 25B, the target command gradation value Sbt for representing the target value Cbt in relation to the command gradation value Sb in the column region j is calculated using the following equation (linear interpolation based on line AB). In the column region j, the read gradation value is higher than the target value Cbt.

$$Sbt=Sa+\{(Sb-Sa)\times(Cbt-Caj)/(Cbj-Caj)\}$$

The target command gradation value Sbt is calculated for each column region with respect to command gradation value Sb. The following equation is used to calculate the correction value Hb for cyan with respect to command gradation value Sb in each column region. The correction values for the other command gradation values (Sa, Sc) and the correction values for the other colors (yellow, magenta, black) are calculated in a similar manner.

$$Hb=(Sbt-Sb)/Sb$$

Figure 26:
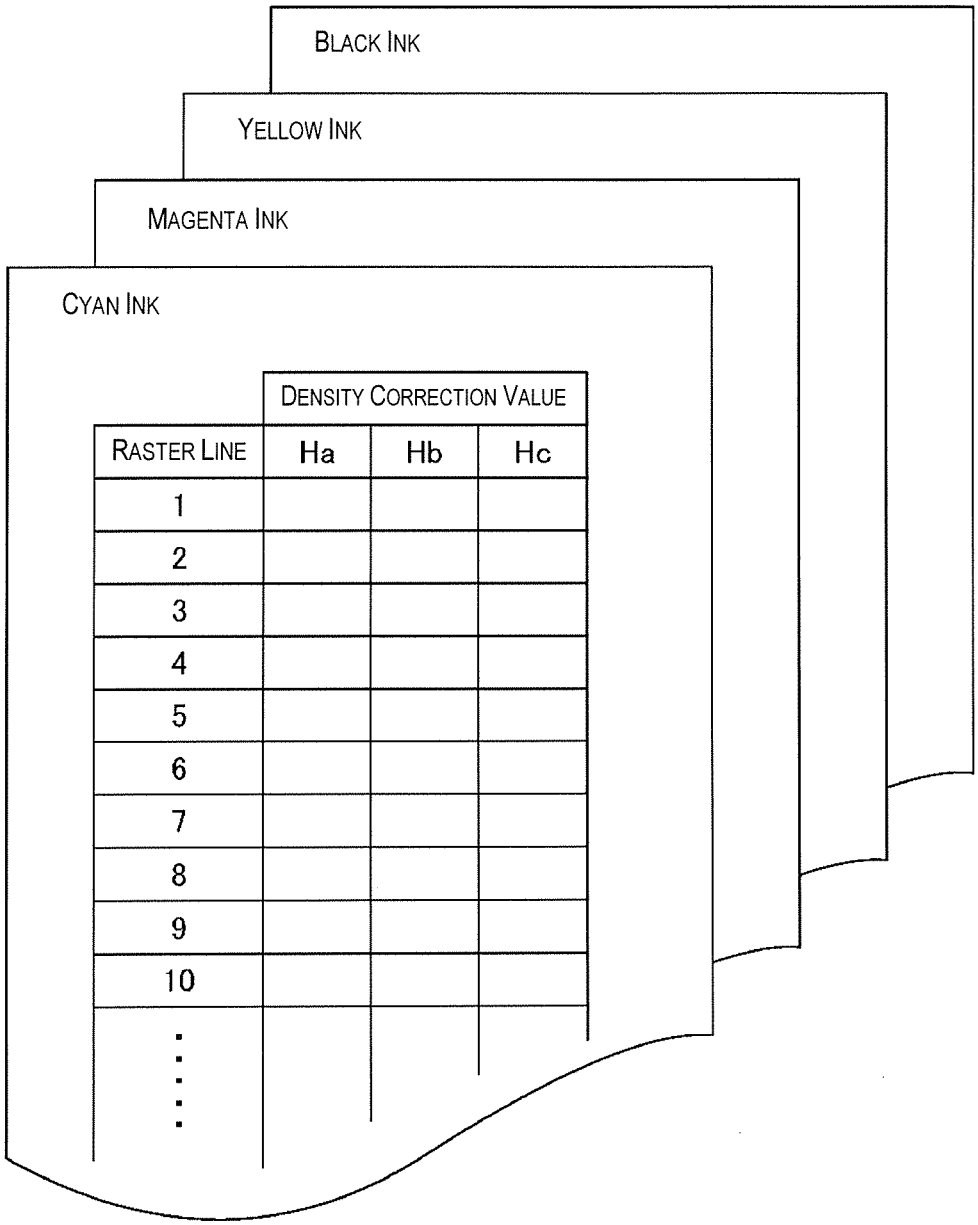
FIG. 26 is a diagram showing a correction value table related to each nozzle column (CMYK)

FIG. 26 is a diagram showing a correction value table related to each nozzle column (CMYK). The correction values H calculated as described above are summarized in the correction value table shown here. In the correction value table, the correction values (Ha, Hb, Hc) corresponding to the three command gradation values (Sa, Sb, Sc) are set for each column region. This correction value table is stored in the memory device 13 of the printer 1 which has printed the test pattern for calculating the correction values H. Afterwards, the printer 1 is shipped to the user.

When the user begins to use the printer 1, the printer driver is installed in a computer 50 connected to the printer 1. Then, the printer driver requests the transmission of the correction values H stored in the memory device 13 of the printer 1 to the computer 50. The printer driver stores the correction values H transmitted from the printer 1 to the memory inside the computer 50.

When the gradation values S_in before correction are the same as any of the command gradation values Sa, Sb, and Sc, the correction values H corresponding to each command gradation value can be the correction values Ha, Hb, and Hc stored in the memory of the computer 50. For example, when the uncorrected gradation value S_in before correction equals Sc, the gradation value S_out after correction is obtained using the following equation.

$$S_out=Sc\times(1+Hc)$$

Figure 27:
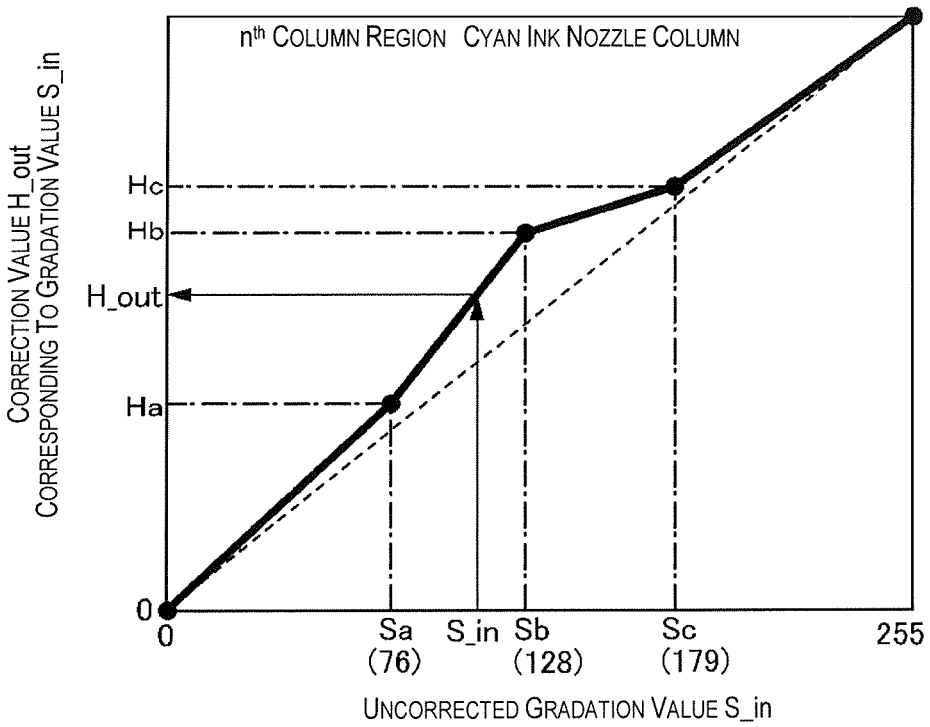
FIG. 27 is a diagram showing the calculation of correction values H corresponding to each gradation value related to the nth column region for cyan.

FIG. 27 is a diagram showing the calculation of correction values H corresponding to each gradation value related to the nth column region for cyan. The horizontal axis represents the uncorrected gradation value S_in before correction, and the vertical axis represents the correction value H_out corresponding to the uncorrected gradation value S_in before correction. When the uncorrected gradation value S_in before correction differs from the command gradation value, the correction value H_out corresponding to the uncorrected gradation value S_in before correction is calculated.

For example, when the uncorrected gradation value S_in before correction is between the command gradation values Sa and Sb as shown in FIG. 27, the correction value H_out is calculated using the following equation via linear interpolation of the correction value Ha for the command gradation value Sa and the correction value Hb for the command gradation value Sb.

$$H_out=Ha+\{(Hb-Ha)\times(S_in-Sa)/(Sb-Sa)\}$$

$$S_out=S_in\times(1+H_out)$$

When the uncorrected gradation value S_in before correction is smaller than command gradation value Sa, the correction value H_out is calculated via linear interpolation of the lowest gradation value 0 and command gradation value Sa. When the uncorrected gradation value S_in before correction is greater than command gradation value Sc, the correction value H_out is calculated via linear interpolation of the highest gradation value 255 and command gradation value Sc.

The uncorrected gradation value S_in (256-gradation data) for each pixel is corrected by the printer driver in the density correction processing (S208 in FIG. 8) using the correction value H set for each color, for each column region for the pixel data, and for each gradation value. In this way, the gradation values S_in of the pixels corresponding to the column regions that appear to have a light density are corrected to dark gradation values S_out, and the gradation values S_in of the pixels corresponding to the column regions that appear to have a dark density are corrected to light gradation values S_out.

Other Embodiments

For the embodiment above, a description has primarily been given of a printing system with an inkjet printer, but the disclosure of a density irregularity correction method and the like are also included therein. Also, the embodiment is intended to facilitate the description of the invention and should not be interpreted as limiting the invention in any way. It shall be apparent that the invention can be modified or improved upon as long as no departure is made from the spirit of the invention, and that the invention includes analogs thereof. The embodiments described below are also included in the invention.

<Printer>

In the embodiment described above, an example is given of a printer that includes a plurality of heads aligned along the paper width (a "line head printer"), and forms images by conveying paper beneath the stationary heads. However, the invention is not limited thereby; e.g., a plurality of heads can be aligned in the nozzle column direction so that the end portions of each nozzle column in the plurality of heads overlap. The printer ("serial printer") can form images by alternatingly moving the plurality of heads relative to the paper in a direction intersecting the nozzle column direction, and conveying the paper in the nozzle column direction relative to the plurality of heads. In this scheme, as in the embodiment described above, printing data can be obtained for the overlapping region in which each of the heads overlap by performing a halftone process on data in which the nozzle usage rate is multiplied by the dot incidence rate data (level data) for each of the dot sizes.

<Fluid-Ejecting Device>

In the embodiment described above, the fluid-ejecting device is an inkjet printer. However, the invention is not limited thereby. The fluid-ejecting device can be applied not only to printers, but to various types of industrial devices as well. For example, the invention can be applied to printing equipment for applying a pattern to fabric, a color filter manufacturing device, a manufacturing device for displays such as organic EL displays, and DNA chip manufacturing devices for applying a solution containing dissolved DNA to a chip to manufacture a DNA chip. The fluid ejecting method can be a piezo method in which voltage is applied to a drive element (piezo element) to expand and contract an ink chamber and eject a fluid. The method can also be a thermal method in which a heating element generates a bubble inside the nozzle, and the bubble ejects the fluid. The fluid does not have to be a liquid such as ink; it can also be a powder.

What is claimed is:

1. A fluid-ejecting device comprising:

(A) a first nozzle column having first nozzles for ejecting a fluid, the first nozzle column being aligned in a predetermined direction;

(B) a second nozzle column having second nozzles for ejecting a fluid, the second nozzle column being aligned in the predetermined direction, and arranged to form an overlapping region in which an end portion toward one end in the predetermined direction overlaps an end portion at another end of the first nozzle column in the predetermined direction; and (C) a controller for ejecting a fluid from the first nozzle column and the second nozzle column in accordance with dot data indicating a dot size converted from inputted image data, the controller ejecting a fluid from the first nozzles in the overlapping region in accordance with dot data obtained from a halftone process performed after multiplying a usage rate of the first nozzle column by incidence rate data for each of the dot sizes, and ejecting the fluid from the second nozzles in the overlapping region in accordance with dot data obtained from a halftone process performed after multiplying the usage rate of the second nozzle column by incidence rate data for each of the dot sizes.

2. The fluid-ejecting device of claim 1, wherein the controller replicates, among the inputted image data, image data corresponding to the overlapping region, inserts image data corresponding to the replicated overlapping region into the inputted image data, performs a halftone process on data obtained by multiplying the usage rate of the end portion at the another end of the first nozzle column by incidence rate data for each dot size generated on the basis of image data corresponding to the overlapping region, and performs a halftone process on data obtained by multiplying the usage rate for the end portion at the one end of the second nozzle column by incidence rate data for each of the dot sizes generated based on image data corresponding to the inserted overlapping region.

3. The fluid-ejecting device of claim 1, wherein the incidence rate data for each of the dot sizes is determined in accordance with a table indicating the dot size formed in accordance with a gradation value of the inputted image data, and the incidence rate for the dot size.

4. The fluid-ejecting device of claim 3, wherein a different table for determining incidence rate data for each of the dot sizes is used in an overlapping region and in a non-overlapping region which is not an overlapping region.

5. The fluid-ejecting device of claim 1, wherein the usage rate of the first nozzles belonging to an overlapping region is greater than the usage rate of the first nozzles positioned towards the another end relative thereto; and the usage rate of the second nozzles belonging to an overlapping region is greater than the usage rate of the second nozzles positioned towards the one end relative thereto.

6. The fluid-ejecting device in claims 1, wherein a threshold of a dither mask used in the halftone process is established so that the difference in dot density at which predetermined pixel groups are individually formed in accordance with a value obtained by multiplying the usage rate by the incidence rate data for each of the dot sizes is within a predetermined range.

7. A fluid-ejecting device comprising:

(A) a head including a nozzle column in which nozzles for ejecting a fluid are aligned in a predetermined direction;

(B) a moving unit for moving the head in an intersecting direction that intersects the predetermined direction;

(C) a conveyor for conveying in the predetermined direction a medium on which the fluid is ejected; and (D) a controller for performing a first dot forming operation for moving the head in the intersecting direction and ejecting the fluid, and for subsequently performing a second dot forming operation for conveying the medium, moving the head in the intersecting direction, and ejecting the fluid; the controller forming on the medium an overlapping region using one end of the nozzle column in the first dot forming operation and another end of the nozzle column in the second dot forming operation; ejecting the fluid from the nozzle column in accordance with the dot data indicating the dot size converted from the inputted image data; and ejecting the fluid in the overlapping region from the nozzles at the one end in accordance with dot data obtained from a halftone process performed after the usage rate at the one end in the first dot forming operation is multiplied by the incidence rate data for each of the dot sizes; and ejecting the fluid in the overlapping region from the nozzles at the another end in accordance with dot data obtained from a halftone process performed after the usage rate at the another end in the second dot forming operation is multiplied by the incidence rate data for each of the dot sizes.

8. A fluid ejecting method for ejecting fluid from a fluid-ejecting device comprising:

a first nozzle column having first nozzles for ejecting a fluid, the first nozzle column being aligned in a predetermined direction, and a second nozzle column having second nozzles for ejecting a fluid, the second nozzle column being aligned in the predetermined direction, and being arranged to form an overlapping region in which an end portion toward one end in the predetermined direction overlaps with an end portion at another end of the first nozzle column in the predetermined direction; the fluid ejecting method comprising the steps of:

(A) determining, for the overlapping region, dot data obtained from a halftone process performed after the usage rate of the first nozzle column is multiplied by the incidence rate data for each of the dot sizes; and determining, for the overlapping region, dot data obtained from a halftone process performed after the usage rate of the second nozzle column is multiplied by the incidence rate data for each of the dot sizes, and (B) ejecting the fluid from the nozzles of the first nozzle column in the overlapping region in accordance with the dot data of the first nozzle column, and ejecting the fluid from the nozzles of the second nozzle column in the overlapping region in accordance with the dot data of the second nozzle column.

* * * * *